US007358983B2

(12) United States Patent
Yaji et al.

(10) Patent No.: US 7,358,983 B2
(45) Date of Patent: Apr. 15, 2008

(54) PRINTING APPARATUS

(75) Inventors: Masao Yaji, Tokyo (JP); Takashi Nakasendo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 208 days.

(21) Appl. No.: 11/337,443

(22) Filed: Jan. 24, 2006

(65) Prior Publication Data

US 2006/0164499 A1 Jul. 27, 2006

(30) Foreign Application Priority Data

Jan. 24, 2005 (JP) ..... 2005-015116

(51) Int. Cl.
*B41J 2/47* (2006.01)
*B41J 2/385* (2006.01)
*B41J 2/435* (2006.01)

(52) U.S. Cl. ..... 347/255; 347/135; 347/229

(58) Field of Classification Search ..... 347/135, 347/229, 255

See application file for complete search history.

(56) References Cited

U.S. PATENT DOCUMENTS 6,034,703 A * 3/2000 Broddin et al. ..... 347/131
6,233,036 B1 * 5/2001 Masubuchi et al. ..... 355/38

FOREIGN PATENT DOCUMENTS

JP 08-230234 9/1996

* cited by examiner

*Primary Examiner*—An H. Do
*Assistant Examiner*—Sarah Al-Hashimi
(74) *Attorney, Agent, or Firm*—Rabin & Berdo, P.C.

(57) ABSTRACT

A printing apparatus for printing an image onto a recording medium based on input image data, comprises an electrostatic latent image carrier for forming an electrostatic latent image, and an exposure controller for forming the electrostatic latent image corresponding to one pixel upon exposure of the electrostatic latent image carrier with a combination of a plurality of different exposure amounts, wherein the exposure controller performs the exposure with the combination of the plurality of exposure amounts in a manner to satisfy a condition for an index value LNR expressed by a following general equation (1) using an optical density od (n) standardized on the condition of the maximum optical density equal to 1.0, identification information comb assigned to identify each combination of the plurality of exposure amounts, and the number of varieties m of a cumulative exposure amount used for modulation of the image data.

$$LNR \leq 2/m \tag{1}$$

$$LNR(comb) = \sqrt{\sum_{n=0}^{m-3} [\{(od(n+2) - od(n+1)) - (od(n+1) - od(n))\}^2] / (m-2)}\,.$$

8 Claims, 44 Drawing Sheets

FIG. 4

| TONE VALUE (DECIMAL) | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 14 | 20 | 26 | 28 | 2C | 2F | 30 | 34 | 38 | 3B | 3E | 41 | 46 | 49 | 4B | 4D | 52 | 54 | 56 | 59 | 5B | 6D | 6F | 69 | 6B | 6E | 76 | 79 | 7D | 7F | 93 | DD |

FIG. 5

| PIX (DECIMAL) | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| PTN (HEXADECIMAL) | 01 | 03 | 81 | 83 | 45 | 43 | C1 | C3 | C7 | 0D | 0B | 0F | 89 | 8B | 8F | 49 | 4D | 4F | C9 | CB | 11 | 13 | 91 | 95 | 51 | 53 | D1 | 19 | 1F | 9B | 5F | 35 |

FIG. 6

| LED NUMBER | 1 | 2 | 3 | 4 | 5 | ····· | 4990 | 4991 | 4992 |
|---|---|---|---|---|---|---|---|---|---|
| IMAGE DATA | 7 | 8 | 6 | 10 | 2 | ····· | 10 | 31 | 15 |
| DRIVING PATTERN | C3 | C7 | C1 | 0B | 81 | ····· | 0B | 35 | 49 |

FIG. 14

| | STBR1 | STBR2 | STBR3 | STBR4 | STBR5 | STBR6 | STBR7 | STBR8 |
|---|---|---|---|---|---|---|---|---|
| (a) | 4 x T | 8 x T | 64 x T | 32 x T | 16 x T | 1 x T | 2 x T | 16 x T |
| (b) | 16 x T | 8 x T | 64 x T | 2 x T | 4 x T | 32 x T | 1 x T | 16 x T |
| (c) | 64 x T | 4 x T | 32 x T | 1 x T | 16 x T | 8 x T | 2 x T | 16 x T |
| (d) | 1 x T | 4 x T | 16 x T | 64 x T | 2 x T | 32 x T | 8 x T | 16 x T |

T: UNIT SET TIME

FIG. 19

| CUMULATIVE EXPOSURE AMOUNT (xE) | 16 | 17 | 18 | 19 | ... | 61 | 62 | 63 | 64 | 65 | 66 | 67 | ... | 78 | 79 | 80 | 81 | 82 | 83 | 84 | 85 | 86 | 87 | 88 | 89 | 90 | ... | 111 | 112 | 113 | 114 | 115 | 116 | ... | 140 | 141 | 142 |
|---|---|---|---|---|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 01 | 05 | 03 | 07 | ... | D5 | D3 | D7 | 19 | 1D | 1B | 1F | ... | DB | DF | 21 | 25 | 23 | 27 | A1 | A5 | A3 | A7 | 61 | 65 | 63 | ... | EF | 31 | 35 | 33 | 37 | 61 | ... | F9 | FD | FB |

FIG. 20

| CUMULATIVE EXPOSURE AMOUNT [xE] | 10 | 17 | 18 | 19 | ... | 61 | 62 | 63 | 64 | 65 | 66 | 67 | ... | 78 | 79 | 80 | 81 | 82 | 83 | 84 | 85 | 86 | 87 | 88 | 89 | 90 | ... | 111 | 112 | 113 | 114 | 115 | 116 | ... | 140 | 141 | 142 |
|---|---|---|---|---|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 01 | 05 | 03 | 07 | ... | DB | D3 | D7 | D7 | 1D | 1B | 1F | ... | DB | DF | DF | DF | DF | DF | DF | A5 | A3 | A7 | A7 | 65 | 63 | ... | EF | EF | EF | EF | 37 | B1 | ... | F9 | FD | FB |

FIG. 22

| CUMULATIVE EXPOSURE AMOUNT (xE) | 16 | 17 | 18 | 19 | ... | 61 | 62 | 63 | 64 | 65 | 66 | 67 | ... | 78 | 79 | 80 | 81 | 82 | 83 | 84 | 85 | 86 | 87 | 88 | 89 | 90 | ... | 111 | 112 | 113 | 114 | 115 | 116 | ... | 140 | 141 | 142 |
|---|---|---|---|---|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 01 | 05 | 03 | 07 | ... | D5 | D3 | D7 | 1D | 1B | 1F | 99 | ... | DF | A5 | A3 | A7 | 05 | 03 | 07 | E1 | E5 | E3 | E7 | 29 | 2D | ... | 77 | F1 | F5 | F3 | F7 | 39 | ... | FF | FF | FF |

FIG. 25

| | | |
|---|---|---|
| PIX (DECIMAL) | 0 | 31 |
| PTN (HEXADECIMAL) | 01 | FB |

FIG. 26

| | | | | | | | | | |
|---|---|---|---|---|---|---|---|---|---|
| LED NUMBER | 1 | 2 | 3 | 4 | 5 | ····· | 4990 | 4991 | 4992 |
| IMAGE DATA | 0 | 31 | 31 | 0 | 31 | ····· | 31 | 0 | 31 |
| DRIVING PATTERN | 01 | FB | FB | 01 | FB | ····· | FB | 01 | FB |

16_8_4_2_32_64_1_16

| STBR1 | STBR2 | STBR3 | STBR4 | STBR5 | STBR6 | STBR7 | STBR8 |
|---|---|---|---|---|---|---|---|
| 16 × T | 8 × T | 4 × T | 2 × T | 32 × T | 64 × T | 1 × T | 16 × T |

T: UNIT SET TIME

| STBR1 | STBR2 | STBR3 | STBR4 | STBR5 | STBR6 | STBR7 | STBR8 |
|---|---|---|---|---|---|---|---|
| 128 × T | 64 × T | 32 × T | 16 × T | 8 × T | 4 × T | 2 × T | 1 × T |

T: UNIT SET TIME

| | | | | | | | | | |
|---|---|---|---|---|---|---|---|---|---|
| LED NUMBER | 1 | 2 | 3 | 4 | 5 | ..... | 4990 | 4991 | 4992 |
| TONE VALUE | 7 | 8 | 6 | 10 | 2 | ..... | 10 | 31 | 15 |
| DRIVING PATTERN | 34 | 38 | 30 | 3E | 26 | ..... | 3E | DD | 4D |

FIG. 34

| TONE VALUE (DECIMAL) | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 14 | 20 | 26 | 28 | 2C | 2F | 30 | 34 | 38 | 3B | 3E | 41 | 46 | 49 | 4B | 4D | 52 | 54 | 56 | 59 | 5B | 5D | 61 | 69 | 6B | 6E | 75 | 79 | 7D | 86 | 93 | DD |

FIG. 35

| TONE VALUE (DECIMAL) | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| EXPOSURE AMOUNT [xE] | 20 | 32 | 38 | 40 | 44 | 47 | 48 | 52 | 56 | 59 | 62 | 67 | 70 | 73 | 75 | 77 | 82 | 84 | 86 | 89 | 91 | 93 | 97 | 105 | 107 | 110 | 117 | 121 | 125 | 134 | 147 | 221 |

FIG. 36

| CUMULATIVE EXPOSURE AMOUNT [xE] | 0 | 1 | 2 | 3 | 4 | 5 | ... | 93 | 94 | 95 | 96 | 97 | 98 | 99 | 100 | 101 | 102 | ... | 125 | 126 | 127 | 128 | 129 | 130 | 131 | 132 | 133 | 134 | 135 | 136 | ... | 253 | 254 | 255 |
|---|---|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 0 | 1 | 2 | 3 | 4 | 5 | ... | 5D | 5E | 5F | 60 | 61 | 62 | 63 | 64 | 65 | 66 | ... | 7D | 7E | 7F | 80 | 81 | 82 | 83 | 84 | 85 | 86 | 87 | 88 | ... | FD | FE | FF |

FIG. 39

| CUMULATIVE EXPOSURE AMOUNT [xE] | 0 | 1 | 2 | 3 | 4 | 5 | ... | 93 | 94 | 95 | 96 | 97 | 98 | 99 | 100 | 101 | 102 | ... | 125 | 126 | 127 | 128 | 129 | 130 | 131 | 132 | 133 | 134 | 135 | 136 | ... | 253 | 254 | 255 |
|---|---|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 0 | 1 | 2 | 3 | 4 | 5 | ... | 5D | 6E | 5F | 5F | 6F | 6F | 6F | 6F | 6F | 66 | ... | 7D | 7E | 7F | 7F | 7F | 7F | 7F | 7F | 7F | 7F | 7F | 88 | ... | FD | FE | FF |

FIG. 41

| LED NUMBER | 1 | 2 | 3 | 4 | 5 | ..... | 4990 | 4991 | 4992 |
|---|---|---|---|---|---|---|---|---|---|
| TONE VALUE | 7 | 8 | 6 | 10 | 2 | ..... | 10 | 31 | 15 |
| DRIVING PATTERN | 34 | 38 | 30 | 3E | 26 | ..... | 3E | EB | 4D |

FIG. 42

| TONE VALUE (DECIMAL) | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 14 | 20 | 26 | 28 | 2C | 2F | 30 | 34 | 38 | 3B | 3E | 43 | 46 | 49 | 4B | 4D | 52 | 54 | 56 | 59 | 5B | 5D | 67 | 6F | 71 | 74 | 7B | 7F | 8B | 94 | A1 | EB |

FIG. 45a

| CUMULATIVE EXPOSURE AMOUNT (μE) | 0 | 1 | 2 | 3 | 4 | 5 | ... | 93 | 94 | 95 | 96 | 97 | 98 | 99 | 100 | 101 | 102 | ... | 121 | 122 | 123 | 124 | 125 | 126 | 127 | 128 | 129 | 130 | 131 | 132 | ... | 253 | 254 | 255 |
|---|---|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 0 | 1 | 2 | 3 | 4 | 5 | ... | 5D | 5E | 5F | 66 | 67 | 68 | 69 | 6a | 6b | 6c | ... | 7F | 80 | 81 | 82 | 83 | 84 | 85 | 86 | 87 | 88 | 89 | 8A | ... | FF | FE | FF |

FIG. 45b

| CUMULATIVE EXPOSURE AMOUNT [x] | 0 | 1 | 2 | 3 | 4 | 5 | ... | 93 | 94 | 95 | 96 | 97 | 98 | 99 | 100 | 101 | 102 | ... | 121 | 122 | 123 | 124 | 125 | 126 | 127 | 128 | 129 | ... | 240 | 241 | ... | 253 | 254 | 255 |
|---|---|---|---|---|---|---|---|---|---|---|---|---|---|---|---|---|---|---|---|---|---|---|---|---|---|---|---|---|---|---|---|---|---|---|
| DRIVING PATTERN (HEXADECIMAL) | 0 | 1 | 2 | 3 | 4 | 5 | ... | 5D | 6E | 5F | 60 | 61 | 62 | 63 | 6a | 6b | 6c | ... | 7F | 80 | 89 | 8A | 8B | 8C | 8D | 8E | 8F | ... | FE | FF | ... | FF | FF | FF |

PRINTING APPARATUS

BACKGROUND OF THE INVENTION

1. Field of the Invention

This invention relates to a printing apparatus for printing an image on a recording medium based on input image data.

2. Description of Related Art

Conventionally known as a printing apparatus is such as employing an electrophotographic process in which images are formed upon fixation of toner on predetermined recording media, and especially such a printing apparatus as achieving a tone-expression has been proposed (see, e.g., Japanese Patent Laid-Open No. H08-230234). In the printing apparatus as achieving the tone-expression, time required to expose one pixel is divided into predetermined time periods to set different exposure amount for each time period. The printing apparatus as described above adopts a driving method in which an exposing section is selectively enabled or disabled for each time period based on image data to correspond tone of the image information upon control of a cumulative exposure amount per pixel. Furthermore, such a driving method has been also proposed for this printing apparatus, that a time period required to correct the cumulative exposure amount is added to e period to facilitate an improvement in a printing quality.

The conventional printing apparatus, however, has a problem with a linear tone reproduction curve even where adopting any driving methods as described above since the cumulative exposure amount is set to a parameter used for modulation of image data.

To explain this problem in detail, time required to expose one pixel is divided into eight time periods, in which each exposure amount for each of eight time periods is set to e[0], e[1], e[2], e[3], e[4], e[5], e[6], and e[7] in order of timing occurrence and the each time period is set as described in following Table 1. It is to be noted that an exposure amount unit E is obtained per an exposure time unit T and thus 256 (0~255×E) patterns of the cumulative exposure amount are realized in total according to combinations of patterns between enable and disable states during divided eight timings.

TABLE 1

| | Setting Example of Exposure Amount and Exposure Time | | | | | | | |
|---|---|---|---|---|---|---|---|---|
| | Exposure Amount | | | | | | | |
| | e [0] | e [1] | e [2] | e [3] | e [4] | e [5] | e [6] | e [7] |
| Exposure Time | $T * 2^0$ | $T * 2^1$ | $T * 2^2$ | $T * 2^3$ | $T * 2^4$ | $T * 2^5$ | $T * 2^6$ | $T * 2^7$ |

With the conventional printing apparatus, an exposed location shifts over time in association with shift of the recording medium even where the exposure time is changed to change the exposure amount linearly as described above. Therefore, such a tone-expression as developed based on the above described setting results in occurrence of domains indicated by alphabets A, B in FIG. 47, at which the image information and the tone reproduction do not correspond linearly but reverse to each other. As described above, the problem with the linear tone reproduction curve cannot be solved in using the conventional printing apparatus.

This invention has been invented in consideration of the above background, and it is an object of the invention to provide a printing apparatus capable of realizing the excellent linear tone reproduction curve.

SUMMARY OF THE INVENTION

According to this invention for achieving the above described object, a printing apparatus for printing an image onto a recording medium based on input image data, comprises an electrostatic latent image carrier for forming an electrostatic latent image, and an exposure controller for forming the electrostatic latent image corresponding to one pixel upon exposure of the electrostatic latent image carrier with a combination of a plurality of different exposure amounts, in which the exposure controller performs the exposure with the combination of the plurality of exposure amounts in a manner to satisfy a condition for an index value LNR expressed by a following general equation (1) using an optical density od (n) standardized on the condition of the maximum optical density equal to 1.0, identification information comb assigned to identify each combination of the plurality of exposure amounts, and the number of varieties m of a cumulative exposure amount used for modulation of the image data $$LNR \leq 2/m \tag{1}$$

$$LNR(comb) = \sqrt{\sum_{n=0}^{m-3} [\{(od(n+2) - od(n+1)) - (od(n+1) - od(n))\}^2] / (m-2)}.$$

With the printing apparatus according to this invention, a relative position of the exposed locations in consideration of interaction of a combination of the plurality of exposure amounts for forming one pixel in using the index value LNR expressed by the above general equation (1).

Herein, the exposure controller forms the electrostatic latent image expressing a tone per pixel upon exposing the electrostatic latent image carrier with a combination of the plurality of exposure amounts in a case of the image data per pixel of multiple values.

To be more precise, the exposure controller assigns a light emitting time of a light emitting unit for exposure, thereby being able to form the electrostatic latent image expressing a tone per pixel upon exposing the electrostatic latent image carrier with a combination of the plurality of exposure amounts.

The exposure controller desirably forms the electrostatic latent image expressing a tone per pixel upon exposing the electrostatic latent image carrier with a combination of the plurality of exposure amounts in proportion to two's power, respectively.

Furthermore, according to this invention for achieving the above described object, a printing apparatus for printing an image onto a recording medium based on input image data, comprises an electrostatic latent image carrier for forming an electrostatic latent image, and an exposure controller for exposing the electrostatic latent image carrier upon separating exposure positions of a light emitting unit used for exposure by a predetermined distance from a first to $n^{th}$ exposed locations, as overlapping the adjacent exposed locations at least partially, at a time of forming one pixel upon the exposure of plural times from the first to $n^{th}$ exposed locations, as well as for forming the electrostatic latent image expressing a tone per pixel upon control with different exposure amounts from the first to $n^{th}$ exposed locations, in which the exposure controller arranges the first to $n^{th}$ exposed locations expressing the tone per pixel at a location having the smallest summation of an optical density difference obtained from adjacent exposure patterns with respect to each of a first to $2^n$ exposure patterns at a time of the exposure with the first to $2^n$ exposure patterns providing different optical densities.

With the printing apparatus according to this invention, a relative position of the exposed locations in consideration of interaction of a combination of the plurality of exposure amounts for forming one pixel upon arranging the first to $n^{th}$ exposed location expressing a tone per pixel at a location having the smallest summation of difference of such an optical density as resulted from adjacent exposure patterns with respect to each first to $2^n$ exposure pattern at the time of the exposure with the first to $2^n$ exposure pattern resulting different optical densities.

In the meanwhile, the exposure controller exposes the electrostatic latent image carrier as shifting by a predetermined distance an exposure position of the light emitting unit linearly in association with shift of the recording medium, from the first to $n^{th}$ exposed locations.

Furthermore, according to this invention for achieving the above described object, a printing apparatus for printing an image onto a recording medium based on input image data, comprises a light emitting unit arranged with a plurality of light emitting elements in an array form, an electrostatic latent image carrier for forming an electrostatic latent image, and an exposure controller for exposing the electrostatic latent image carrier upon separating exposure positions of the light emitting unit by a predetermined distance from a first to $n^{th}$ exposed locations, as overlapping the adjacent exposed locations at least partially, at a time of forming one pixel upon the exposure of plural times from the first to $n^{th}$ exposed locations using the light emitting element, as well as for forming the electrostatic latent image expressing a tone per pixel upon control with different exposure amounts from the first to $n^{th}$ exposed locations, in which the exposure controller arranges the first to $n^{th}$ exposed location expressing a tone per pixel at a location having the smallest summation of n optical density difference obtained from adjacent exposure patterns with respect to each of a first to $2^n$ exposure patterns at a time of the exposure with the first to $2^n$ exposure patterns providing different optical densities.

With the printing apparatus according to this invention, a relative position of the exposed locations in consideration of interaction of a combination of the plurality of exposure amounts for forming one pixel upon arranging the first to $n^{th}$ exposed location expressing a tone per pixel at a location having the smallest summation of difference of such an optical density as resulted from adjacent exposure patterns with respect to each first to $2^n$ exposure pattern with the light emitting unit arrayed with the light emitting elements in an array form at the time of the exposure with the first to $2^n$ exposure pattern resulting different optical densities.

According to this invention for achieving the above described object, a printing apparatus for printing an image onto a recording medium based on input image data, comprises a recording head arranged with a plurality of recording elements in a main scanning direction, a controller for forming the image for expressing a tone of multiple values per pixel as an assemblage of image elements arranged at the approximately same position in the main scanning direction out of the image elements composing the predetermined number of main scanning line images deviated in an auxiliary scanning direction at a case of recording the image upon shifting the recording head and the recording medium relatively to each other in the auxiliary scanning direction approximately perpendicular to the main scanning direction to set the image recorded in the main scanning direction with the recording head to the main scanning line image, and a driving pattern converter for converting a tone value input correspondingly to each pixel into driving pattern data indicative of a driving pattern of the recording element, in which the driving pattern converter converts the tone value into the driving pattern data such that a ratio between an entire amount of recording energy of the image elements composing one pixel and an increment of an optical density is set to greater than or equal to 0 with respect to increase of the tone value.

The printing apparatus according to this invention can adjust a domain having the optical density decreasing as opposed to increase of the recording energy since converting the tone value into the driving pattern such that a ratio between the entire amount of recording energy of the image elements composing one pixel and an increment of the optical density is set to greater than or equal to 0 with respect to increase of the tone value.

Herein, the printing apparatus according to this invention has the electrostatic latent image carrier for forming the electrostatic latent image and the recording element can be defined as a light emitting element such as a light emitting diode or the like. In this case, the controller forms on the electrostatic latent image carrier an electrostatic latent image forming a tone per pixel based on the driving pattern at the time of exposing the electrostatic latent image using the light emitting element. In the printing apparatus according to this invention, the recording element can be defined as a heating element. In this case, the controller forms on the recording medium an image for expressing a tone per pixel based on the driving pattern at the time of energizing the heating element.

With a printing apparatus according to this invention may employ the following methodology to set a ratio between an entire amount of recording energy of image elements composing one pixel and increment of optical density to greater than or equal to 0 with respect to increase of a tone value.

In the printing apparatus according to this invention, the driving pattern converter may convert a driving pattern for a domain having the optical density decreasing as opposed to increase of the recording energy in the driving pattern data into a driving pattern providing small recording energy and the maximum optical density. Also, the driving pattern converter may eliminate the driving pattern for the domain having the optical density decreasing as opposed to increase of the recording energy.

According to this invention for achieving the above described object, a printing apparatus for printing an image onto a recording medium based on input image data, comprises an electrostatic latent image carrier for forming an electrostatic latent image, an exposing unit for operating scan in a main scanning direction with light emitted from a light emitting element, a controller for forming on the electrostatic latent image carrier the electrostatic latent image expressing a tone of multiple values per pixel defined as an assemblage of image elements arranged at the approximately same position in the main scanning direction out of the image elements composing the predetermined number of main scanning line images deviated in an auxiliary scanning direction at a time of recording the image upon shifting the recording medium in the auxiliary scanning direction approximately perpendicular to the main scanning direction with respect to the exposing unit to set the image recorded with the exposing unit in the main scanning direction to the main scanning line image, and a driving pattern converter for converting a tone value input correspondingly to each pixel into driving pattern data indicative of a driving pattern of the light emitting element, in which the driving pattern converter converts the tone value into the driving pattern data such that a ratio between an entire amount of recording energy of the image elements composing one pixel and an increment of an optical density is set to greater than or equal to 0 with respect to increase of the tone value.

The printing apparatus according to this invention can adjust a domain having the optical density decreasing as opposed to increase of the recording energy since converting the tone value into the driving pattern such that a ratio between the entire amount of recording energy of the image elements composing one pixel and an increment of the optical density is set to greater than or equal to 0 with respect to increase of the tone value, at the time of exposing the electrostatic latent image carrier.

According to this invention for achieving the above described object, a printing apparatus for printing an image onto a recording medium based on input image data, comprises an electrostatic latent image carrier for forming an electrostatic latent image, an exposing unit arranged with a plurality of exposure elements in an array form for forming the electrostatic latent image on the electrostatic latent image carrier upon exposing the electrostatic latent image carrier, and an exposure controller for controlling an exposure amount of the exposing unit in accordance with an exposure position of the electrostatic latent image carrier to be exposed with the exposure element, in which the exposure controller controls the exposure element in a predetermined range from a first to $n^{th}$ exposed locations as overlapping the adjacent exposed locations at least partially, at a time of forming one pixel upon the exposure of plural times from the first to $n^{th}$ exposed locations using the exposure element, and wherein the exposure controller arranges the first to $n^{th}$ exposed locations expressing a tone per pixel at a location having the smallest summation of an optical density difference obtained from adjacent exposure patterns with respect to each of a first to $2^n$ exposure patterns at a time of exposure with the first to $2^n$ exposure patterns providing different optical densities upon controlling with different exposure amounts at least two or more portions out of the first to $n^{th}$ exposed locations for formation of the electrostatic latent image expressing the tone per pixel.

The printing apparatus according to this invention can adjust a domain having the optical density decreasing as opposed to increase of the recording energy since converting the tone value into the driving pattern such that a ratio between the entire amount of recording energy of the image elements composing one pixel and an increment of the optical density is set to greater than or equal to 0 with respect to increase of the tone value, at the time of exposing the electrostatic latent image carrier using the exposing unit arrayed with the plurality of exposure elements in an array form.

According to this invention, the excellent linear tone reproduction curve can be realized upon determining a relative position of the exposed locations in consideration of interaction of a combination of the plurality of exposure amounts for forming one pixel.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein;

FIG. 4 is a table providing an example of a driving pattern data table showing a driving pattern corresponding to a tone value;

FIG. 5 is a table providing a definition example of correspondences between values of image data and driving pattern data of the printing apparatus;

FIG. 6 is a table providing a relation example between an LED element arranged in a main scanning direction, and the corresponding image data and driving pattern data of the printing apparatus;

FIG. 8(*b*) is a graph showing a relation example between a cumulative exposure amount and an optical density resulted from simulation of the printing apparatus, which is conducted upon setting in a strobe time register a different value from the simulation resulting in FIG. 8(*a*);

FIG. 8(*c*) is a graph showing a relation example between a cumulative exposure amount and an optical density resulted from simulation of the printing apparatus, which is conducted upon setting in a strobe time register a different value from the simulations resulting in FIGS. 8(*a*) and 8(*b*), respectively;

FIG. 8(*d*) is a graph showing a relation example between a cumulative exposure amount and an optical density resulted from simulation of the printing apparatus, which is conducted upon setting in the strobe time register a different value from the simulations resulting in FIGS. 8(*a*) to 8(*c*), respectively;

FIG. 14 is a table providing values set in the strobe time register, assigned to obtain the graphs in FIGS. 8(*a*) to 8(*d*);

FIG. 19 is a table showing a relation between a cumulative exposure amount and a corresponding driving pattern in a case where assignment of values set in the strobe time registers is set to values in a line shown in FIG. 14(*a*);

FIG. 20 is a relation example between a cumulative exposure amount and a driving pattern data obtained in a case where an original driving pattern is substituted by a driving pattern having a small cumulative amount and the maximum optical density, with respect to a domain having an optical density decreasing as opposed to increase of a cumulative exposure amount in the cumulative exposure amount and the driving pattern data shown in FIG. 19;

FIG. 22 is a relation example between a cumulative exposure amount and a driving pattern data obtained in a case of eliminating a driving pattern for a domain having an optical density decreasing as opposed to increase of a cumulative exposure amount in the cumulative exposure amount and the driving pattern data shown in FIG. 19;

FIG. 25 is a definition example of correspondence between values of image data and driving pattern data of a printing apparatus according to a third embodiment;

FIG. 26 is a table providing a relation example between an LED element arranged in a main scanning direction, and the image data and the driving pattern data of the printing apparatus;

FIG. 34 is a table providing an example of a driving pattern table indicative of a driving pattern corresponding to a tone value;

FIG. 35 is a table illustrating a relation example between a tone value and an exposure amount;

FIG. 36 is a table illustrating a relation example between a cumulative exposure amount obtained with a combination of strobe times shown in FIG. 30 and a driving pattern table indicative of a corresponding driving pattern;

FIG. 39 is a table illustrating a relation example between a cumulative exposure amount obtained with a combination of strobe times shown in FIG. 30 and a driving pattern table indicative of a corresponding driving pattern, as well as illustrating an example case where a driving pattern used to a domain indicated by alphabets E, F in FIG. 37 is changed;

FIG. 41 is a table illustrating a relation example between an LED element arrayed in a main scanning direction of a printing apparatus according to a fifth embodiment of this invention, and corresponding image data and driving pattern data;

FIG. 42 is a table illustrating an example of a driving pattern table indicative a driving pattern corresponding to a tone value;

FIG. 45(*a*) is a table illustrating a relation example between a cumulative exposure amount obtained with a combination of strobe times shown in FIG. 30 and a driving pattern table indicative of a corresponding driving pattern, as well as illustrating an example case where a driving pattern used to a domain indicated by alphabet E in FIG. 37 is eliminated;

FIG. 45(*b*) is a table illustrating a relation example between a cumulative exposure amount obtained with a combination of strobe times shown in FIG. 30 and a driving pattern table indicative of a corresponding driving pattern, as well as illustrating an example case where a driving pattern used to a domain indicated by alphabet F in FIG. 37 is eliminated;

DETAILED DESCRIPTION OF PREFERRED EMBODIMENTS OF THE INVENTION

Hereinafter, specific embodiments to which this invention applies will be described in detail in reference with drawings.

Described in this embodiment is such a printing apparatus of an electrophotographic recording type as printing images on recording media based on input image data through processes such as electrostatic charge and exposure of a photosensitive drum serving as an electrostatic latent image carrier, development with toner of an electrostatic latent image formed on the electrostatic latent image carrier, transfer of an obtained toner image onto the recording medium, fixation of the toner image onto the recording medium, and the like.

At the time of forming one pixel upon exposure of plural times from a first to $n^{th}$ exposed location which is achieved as scanning those exposed locations with the light emitted by the light emitting element in a main scanning direction, upon division of exposure time for one pixel to be printed on a recording paper as a recording medium, the printing apparatus exposes those exposed locations, i.e., from the first to the $n^{th}$ exposed locations, upon separating exposure positions by a predetermined distance as overlapping the adjacent exposed locations at least partially while expressing a tone per pixel upon control with different exposure amounts (recording energies) toward at least two or more portions in a range from the first to $n^{th}$ exposed locations. In the meanwhile, such a printing apparatus is described below for convenience of explanation, that has a plurality of light emitting diode (hereinafter referred to as LED) elements arranged in an array form as an exposure element (a light emitting element) for irradiating the photosensitive drum for exposure.

The printing apparatus according to the first embodiment is described first.

Figure 1:
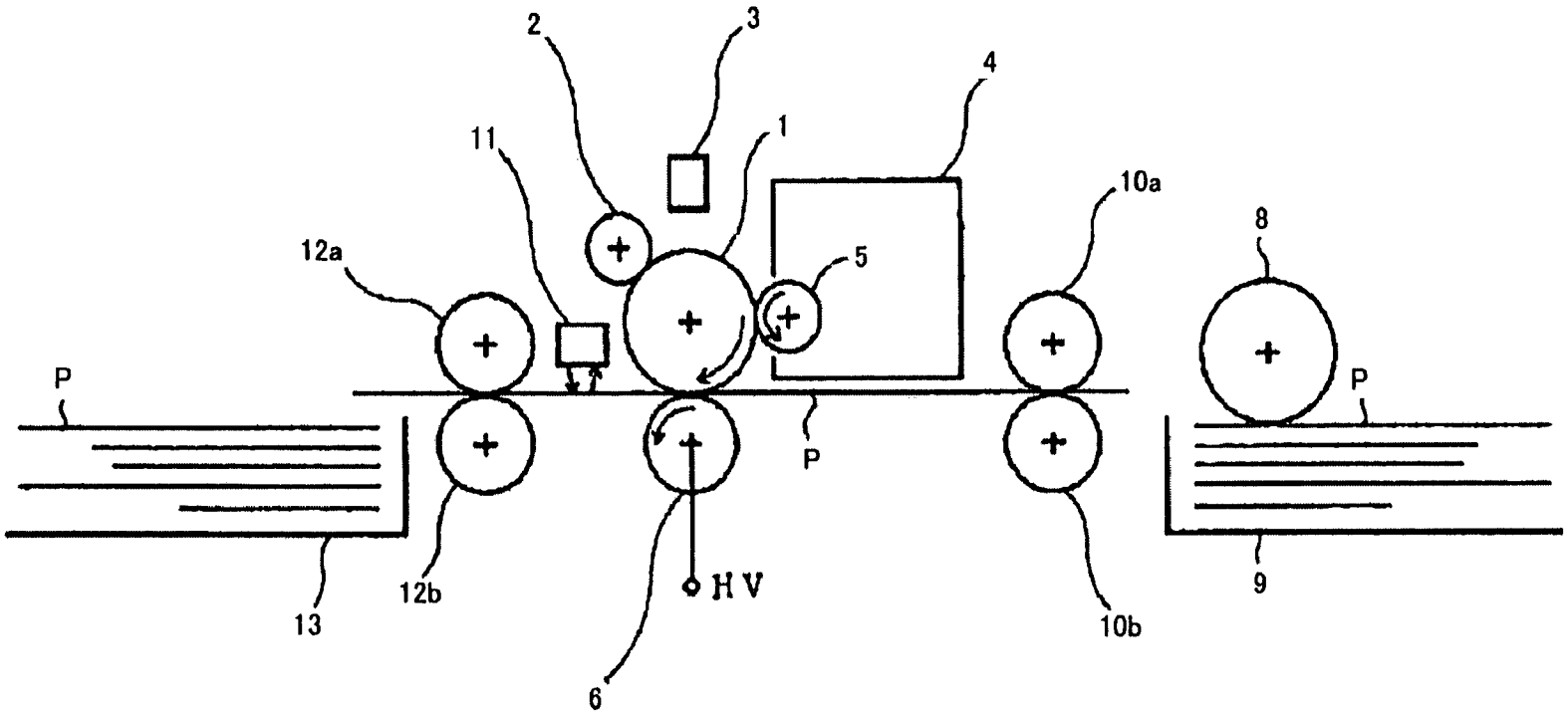
FIG. 1 is a schematic view illustrating a structure of a printing apparatus according to a first embodiment of this invention.

As shown in FIG. 1, the printing apparatus has a photosensitive drum 1 for forming an electrostatic latent image, a charging roller 2 to which high negative voltage is applied to charge a surface of the photosensitive drum 1 to predetermined negative voltage, and an LED head 3 in which the LED elements are arranged in an array form. The printing apparatus forms the electrostatic latent image on the charged photosensitive drum 1 upon selectively rendering the LED elements composing the LED head 3 emit the light. In the meanwhile, the LED head 3 is configured as a tone head capable of expressing density-tone according to input of data of multiple bits and can change an energy amount which is applied to every pixel.

The printing apparatus has a developing unit 4 for developing with toner the electrostatic latent image formed on the photosensitive drum 1. The developing drum 4 charges and supplies the toner to the developing roller 5 applied with the high negative voltage of a predetermined level, and further supplies onto the photosensitive drum 1 the toner supplied to the developing roller 5 to visualize the electrostatic latent image on the photosensitive drum 1.

The printing apparatus has a transfer roller (a transcriber) 6 for transferring a toner image developed with the developing unit 4 onto a recording paper P serving as the recording medium. The transfer roller 6 transfers on the recording paper P with application of a positive electric field the toner image applied with the high positive voltage of a predetermined level, formed on the photosensitive drum 1.

The printing apparatus as described above picks up upon rotating a hopping roller 8 sheet by sheet from a paper cassette 9 the recording papers P stored in the paper cassette 9 installed into a main body of the printing apparatus in a detachably attachable manner, and further conveys the recording paper P with a pair of regist rollers 10*a*, 10*b*.

The printing apparatus furthermore has a density sensor 11 on a downstream side of the photosensitive drum 1 and the transfer roller 6. The density sensor 11 is composed of a light emitting element and a light receiving element and measures density of the toner transferred onto the recording paper P. Yet further, the printing apparatus has a pair of heat rollers 12*a*, 12*b* serving as a fuser for fixing onto the recording paper P the toner image formed thereon. The heat rollers 12*a*, 12*b* fixes the toner image onto the recording paper P upon fusing at high temperature the toner image formed in the recording paper P. The printing apparatus conveys and stores the recording paper P in a stacker 13 subsequent to fixation of the image on the recording paper P in using those heat rollers 12*a*, 12*b*.

Figure 2:
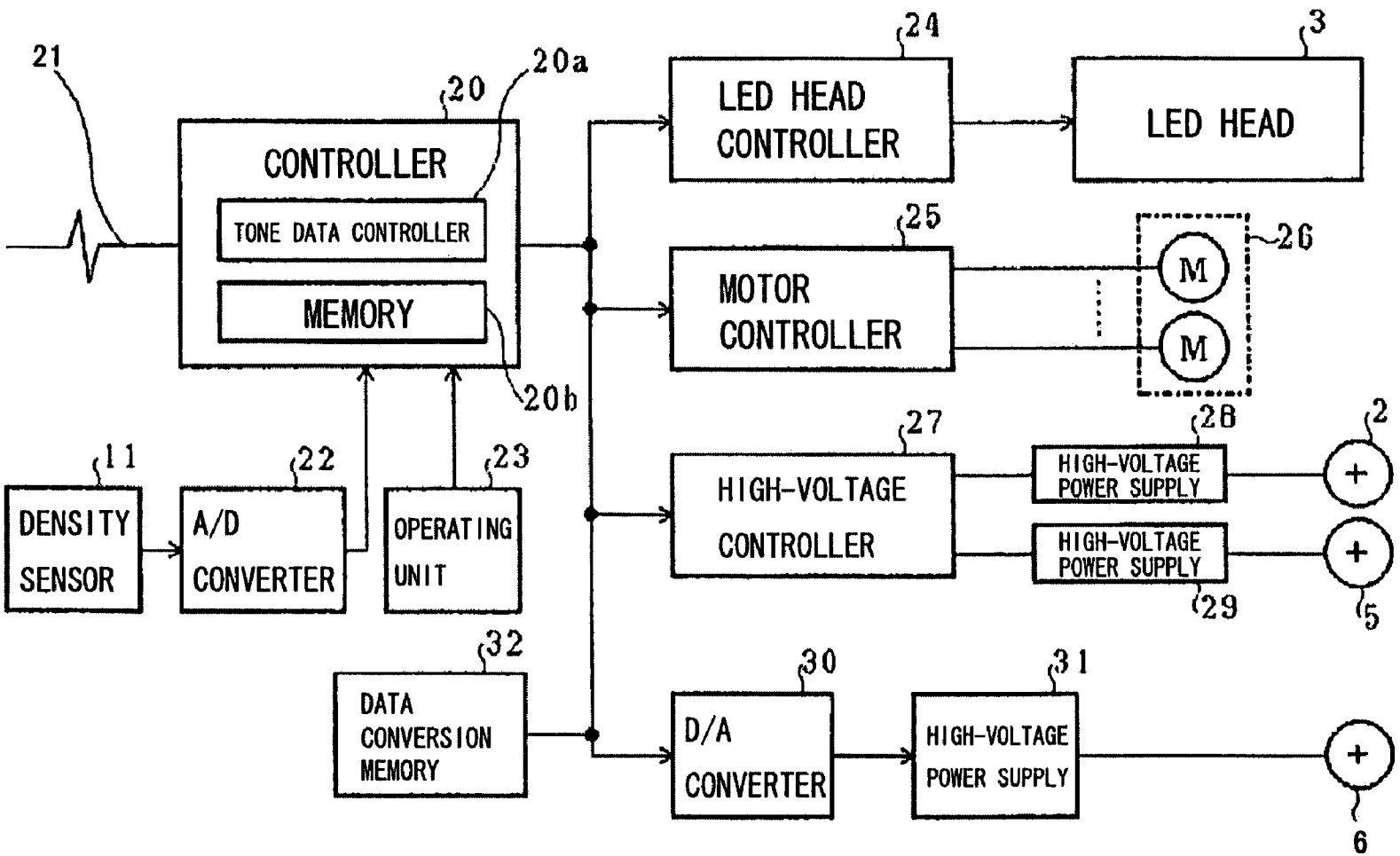
FIG. 2 is a block diagram illustrating a structure of a control system of the printing apparatus.

A control system of the printing apparatus is configured as shown in FIG. 2. That is, the printing apparatus has a controller 20 for controlling each component comprehensively, an interface line 21, an A/D (Analog to Digital) converter 22, an operating unit 23 for operating various inputs, an LED head controller 24 for controlling drive of the LED head 3, a motor controller 25 for controlling drive of a plurality of motors 26, a high-voltage controller 27 for controlling a high-voltage power supplies 28, 29 for applying the high voltage to the charging roller 2 and the developing roller 5, a D/A (Digital to Analog) converter 30, a high-voltage power supply 31 for applying the high voltage to the transfer roller 6, and a data conversion memory 32 for storing tone-adjustment data.

The controller 20 is composed of, e.g., a microprocessor, a ROM (Read Only Memory), a RAM (Random Access Memory), a timer, and the like, and controls each component. To be more precise, the controller 20 has a tone data controller 20*a* composed of the microprocessor and a software to be executed by the microprocessor and a memory 20*b* composed of the ROM, the RAM, and the like. The tone data controller 20*a* executes, if necessary, a printing operation onto the recording paper P using data on a test print pattern composed of the plurality of tones. The tone data controller 20*a* then divides into the required tone number in range from the lowest to the highest density previously set the density of the test print pattern on the recording paper P, measured by the density sensor 11 at the time of the printing operation, thereby setting the data obtained in this way to sampling tone data. The tone data controller 20*a* subsequently adjusts the tone based on a correspondence between the sampling tone data and the tone data of the test print pattern.

The interface line 21 is connected to the controller 20, with which the image data are input from a host apparatus such as a computer installed outside the printing apparatus.

The A/D converter 22 converts the density information detected by the density sensor 11 from an analog value to a digital value. The A/D converter 22 supplies to the controller 20 the density data of the digital value obtained upon conversion.

The operating unit 23 is composed of, e.g., a plurality of keys and formed to operate various settings of the printing apparatus. The information about the input operation is supplied to the controller 20 via the operating unit 23.

The LED head controller 24 converts the image data read out of the memory 20*b* of the controller 20 into such a tone data format as transferable to the LED head 3 and further drives the LED head 3 line by line for a certain time period to shift linearly the exposure position with the LED elements in association with shift of the recording paper P. The LED head controller 24 is connected to the LED head via a plurality of data input lines. With the printing apparatus, the density tone can be expressed pixel by pixel upon disabling any one of the data input lines.

The motor controller 25 is composed of an I/O (Input/Output) port, a motor driver, and the like, and rotates the plurality of motors 26 according to an instruction from the controller 20 to rotate via a predetermined gear line the hopping roller 8, the regist rollers 10*a*, 10*b*, the photosensitive drum 1, the heat rollers 12*a*, 12*b*, and the like.

The high-voltage controller 27 enables or disables the high-voltage power supplies 28, 29 connected to the charging roller 2 and the developing roller 5 according to the instruction from the controller 20. The printing apparatus applies the high voltage to the charging roller 2 and the developing roller 5 according to the enable or disable operation of the high-voltage power supplies 28, 29.

The D/A converter 30 converts instruction data supplied from the controller 20 from a digital value into an analog direct voltage. The D/A converter 30 supplies to the high-voltage power supply 31 the analog direct voltage obtained upon conversion.

The high-power supply 31 outputs the high voltage according to the voltage output from the D/A converter 30. With the printing apparatus, the high voltage output from the high-voltage power supply 31 is applied to the transfer roller 6.

The data conversion memory 32 is composed of a non-volatile memory such as an EEPROM (Electrically Erasable Programmable Read-Only Memory) or the like stores the predetermined tone adjustment data. The controller 20 reads out the tone adjustment data stored in the data conversion memory 32.

Figure 3:
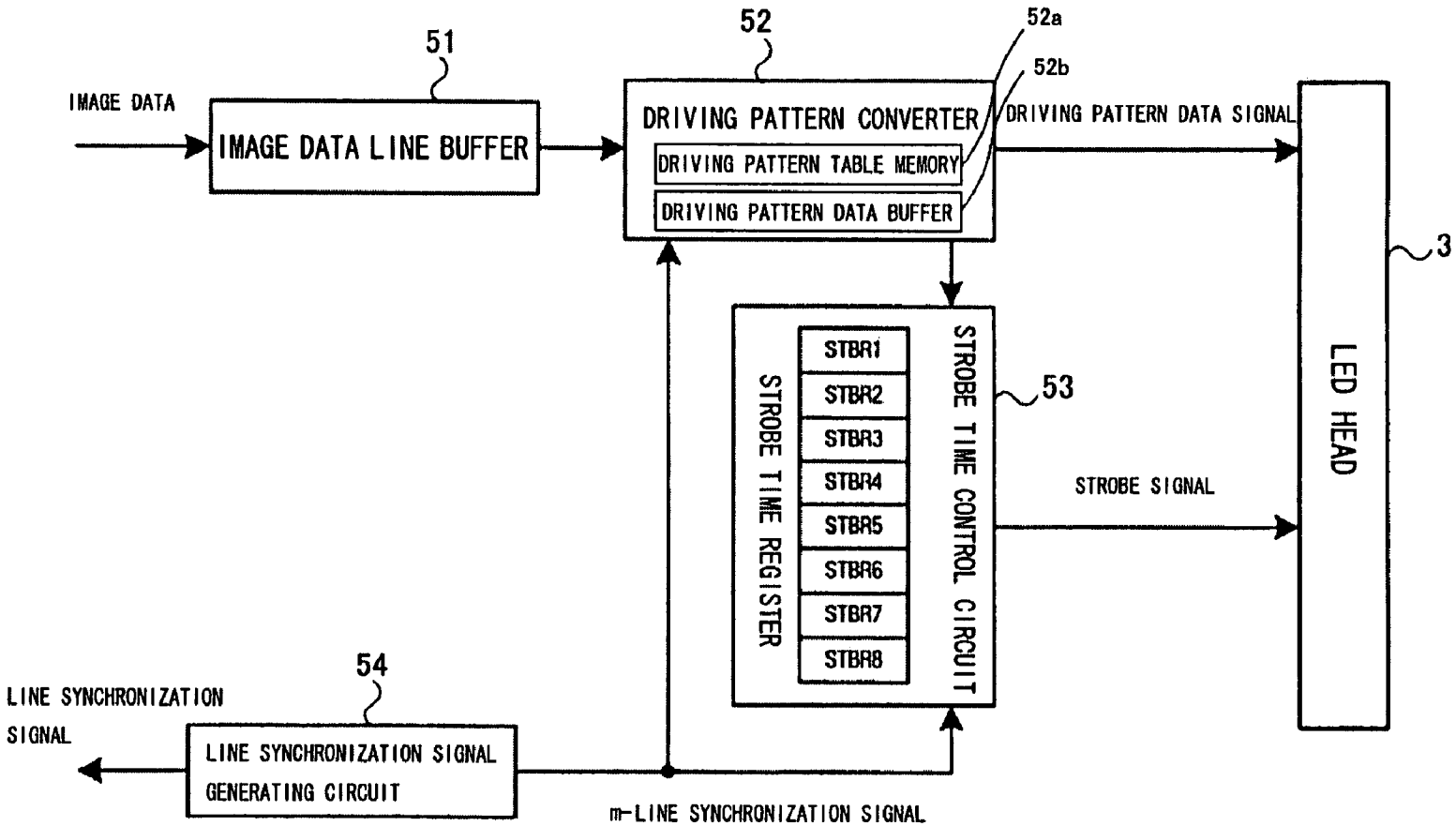
FIG. 3 is a block diagram illustrating a structure of a function performed by a controller and an LED head controller of the printing apparatus.

With the printing apparatus, the data in the tone data format are supplied to the LED head 3 under control of the controller 20 and the LED head controller 24 so the LED head 3 as to be driven. To be more specific, the printing apparatus realizes such a function as shown in FIG. 3 with the controller 20 and the LED head controller 24. In the meanwhile, for convenience of explanation, the image data per pixel are represented by 5 bits whereas driving pattern data per pixel are represented by n=8 bits.

The printing apparatus has an image data line buffer 51 for storing the image data on a line basis, a driving pattern converter 52 for converting the image data read out of the image data line buffer 51 into the driving pattern data indicative of the driving pattern of the LED element, a strobe time control circuit 53 for controlling the strobe time, and a line synchronization signal generating circuit 54 for generating a line synchronization signal and an m-line synchronization signal.

The image data line buffer 51 stores on a line basis the image data transmitted from the host apparatus, according to the line synchronization signal output from the line synchronization signal generating circuit 54. Herein, the image data line buffer 51 has a capacity for two lines. The capacity for one line is used for receiving the image data from the host apparatus while the other capacity for the next one line is used for supplying the already received image data for the previous one line to the driving pattern converter 52.

The driving pattern converter 52 has a driving pattern table memory 52*a* for memorizing a driving pattern table indicative of the driving pattern corresponding to the tone value such as shown in FIG. 4, for example, and a driving pattern data buffer 52*b* for storing the converted driving pattern data. The driving pattern table memory 52*a* is defined as a memory for memorizing address of 5 bits and data of 8 bits. The driving pattern converter 52 converts into the driving pattern data per pixel the image data indicative of the tone value stored in the image data line buffer 51, based on the driving pattern table stored in the driving pattern table memory 52*a*, upon execution of the processing described below. The driving pattern converter 52 then stores the driving pattern data into the driving pattern buffer 52*b* one by another. In the meanwhile, prior to converting the image data into the driving pattern data, the driving pattern converter 52 corrects a peripheral interference, a streak, or the like, if needed, after converting the tone value into the energy, and then converts the corrected energy into the driving pattern data. The driving pattern data signal stored in the driving pattern converter 52 is supplied to the LED head 3 in accordance with the m-line synchronization signal generated by the line synchronization signal generating circuit 54.

Every time the m-line synchronization signal generated by the line synchronization signal generating circuit 54 arrives, the strobe time control circuit 53 loads into an interior timer circuit the values set by a microcomputer, not shown, for the strobe time registers STBR1 to STBR8 juxtaposed to the strobe time control circuit 53, and issues to the LED head 3 such the strobe signal for determining the same exposure amount with respect to each predetermined distance, as having a pulse width in accordance with those values loaded into the timer.

The line synchronization signal generating circuit 54 generates the line synchronization signal while generating the m-line synchronization signal by one-eighth cycle. The line synchronization signal generating circuit 54 transmits the generated line synchronization signal to the host apparatus while supplying the generated m-line synchronization signal to the driving pattern converter 52 and the strobe time control circuit 53.

In the printing apparatus as described above, on the condition that the image data represented by 5 bits are set to PIX whereas the driving pattern data of eight times corresponding to the image data PIX are set to PTN, correspondence between the values of the image data PIX and the driving pattern data PTN is previously defined as shown in FIG. 5, and the image data PIX which are read out of the image data line buffer 51 pixel by pixel are converted into the corresponding driving pattern data PTN.

Where the printing apparatus receives a printing command of the image data for one page from the host apparatus, not shown, the line synchronization signal generating circuit 54 transmits the line synchronization signal via the interface line 21 to the host apparatus to indicate start of line reception. Accordingly, the host apparatus transmits the image data for one line in order of pixel in a main scanning direction of the LED head 3, as many as the number of the LED elements stored in the LED head 3. It is presupposed that the image data per pixel are composed of 5 bits and that 4992 LED elements are formed at a 600 dpi-pitch. The image data amount per line is set to 24960 bits, determined by the equation, 5×4992=24960.

Where terminating the reception of the image data per line to store the image data in the image data line buffer 51, the printing apparatus starts issuing the stored image data to the driving pattern converter 52 in association with arrival of the subsequent line synchronization signal. The driving pattern converter 52 converts the image data per pixel represented by 5 bits based on the correspondence previously defined as shown in FIG. 5, thereby storing the image data by the amount corresponding to the image data per line. On the precondition that the driving pattern data per pixel are composed of 8 bits and that 4992 LED elements are formed, the image data amount per line in the driving pattern converter 52 corresponding to the capacity for one line of the image data line buffer 51 is set to 39936 bits, determined by the equation, 8×4992=39936.

FIG. 6 shows a relation between the LED element arranged in the main scanning direction, and the corresponding image data and driving pattern data. The printing apparatus is in synchronization with the m-line synchronization signal and reads out of the driving pattern converter 52 only the most significant bit PTN[7] of the driving pattern data PTN one by another as many as the number of the LED elements to generate and issue the driving pattern data signal to the LED head 3. The printing apparatus subsequently outputs the strobe signal with a pulse width of the time set in the strobe time register STBR1 from the strobe time control circuit 53 to the LED head 3. Furthermore, the printing apparatus is in synchronization with the subsequent m-line synchronization signal and reads out only the driving pattern data PTN[6] one by another as many as the number of the LED elements to generate and issue the driving pattern data signal to the LED head 3. The printing apparatus outputs the strobe signal with a pulse width of the time set in the strobe time register STBR2 from the strobe time control circuit 53 to the LED head 3. The printing apparatus completes exposure of the data corresponding to the capacity for one line of the image data line buffer 51 upon repeating execution of the above described sequence eight times.

That is, the bits PIN[7] to PIN[0] from the most significant bit to the least significant bit of the driving pattern data PTN of 8 bits are respectively corresponding in this order to the strobe signals with a pulse width indicated by the times set in the strobe time registers STB1 to STB8. The printing apparatus controls the light emission in a manner that the LED element emits light in a case of the bits PTN[7] to PTN[0] respectively equal to "1", upon enabling a switch element in the LED head 3 at the timing of the corresponding strobe signal and that LED element does not emit light in a case of the bits PTN[7] to PTN[0] respectively equal to "0", upon disabling the switch element in the LED head 3 at the timing of the corresponding strobe signal. Therefore, the cumulative exposure amount per pixel is determined based on the value of the driving pattern data PIN and values set in the strobe time registers STBR1 to STBR8. More specifically, the printing apparatus realizes the exposure of 256 patterns in total, i.e., from the first exposure pattern to the 256th ($=2^n=2^8$) exposure pattern obtaining the different optical densities, as the exposure pattern of the photosensitive drum 1.

Figure 7:
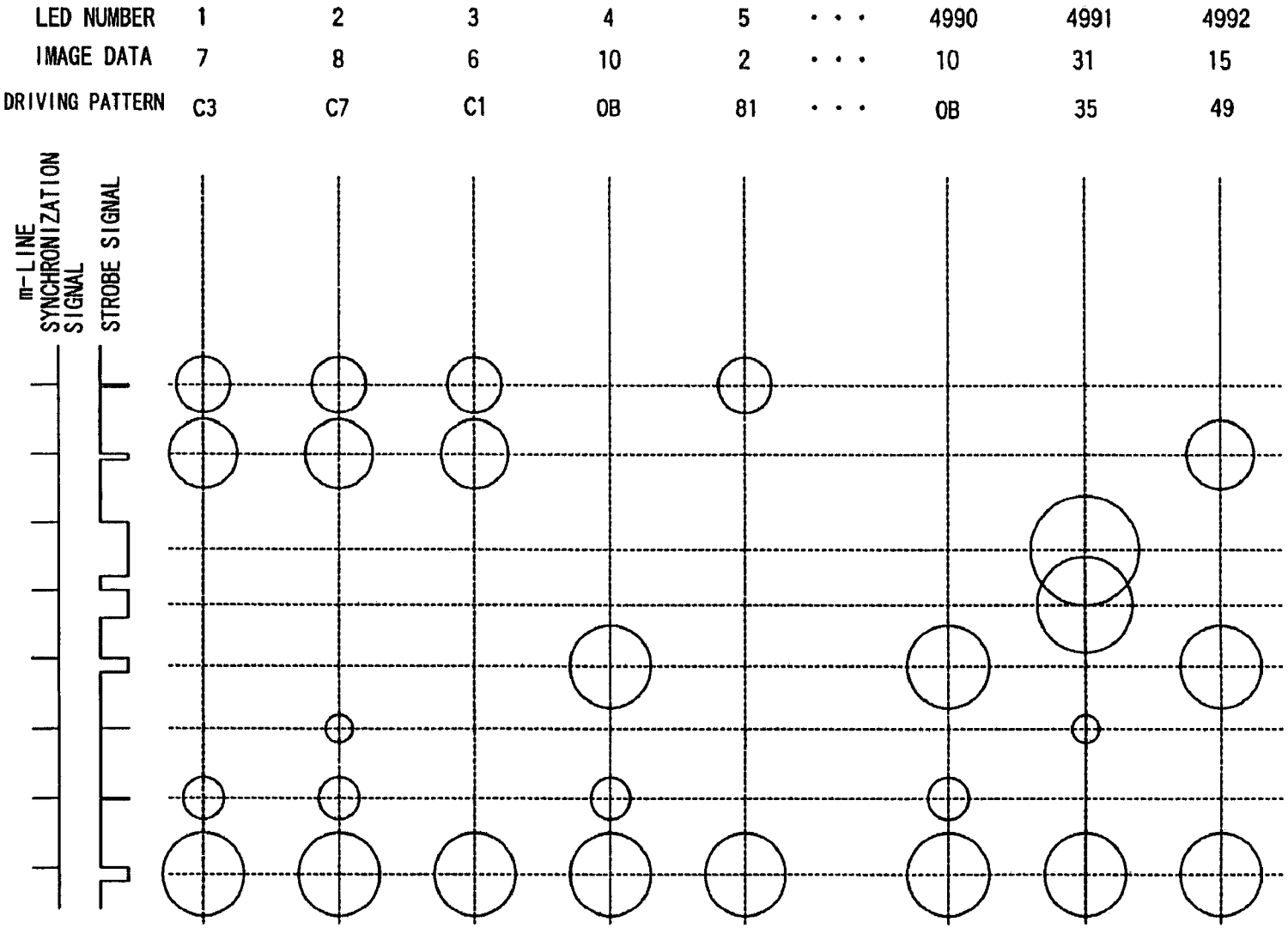
FIG. 7 shows a typical light emission status of the LED element as generating according to the image data and the driving pattern data shown in FIG. 6, in association with relations to waveforms of an m-line synchronization signal and a strobe signal.
Figure 8A:
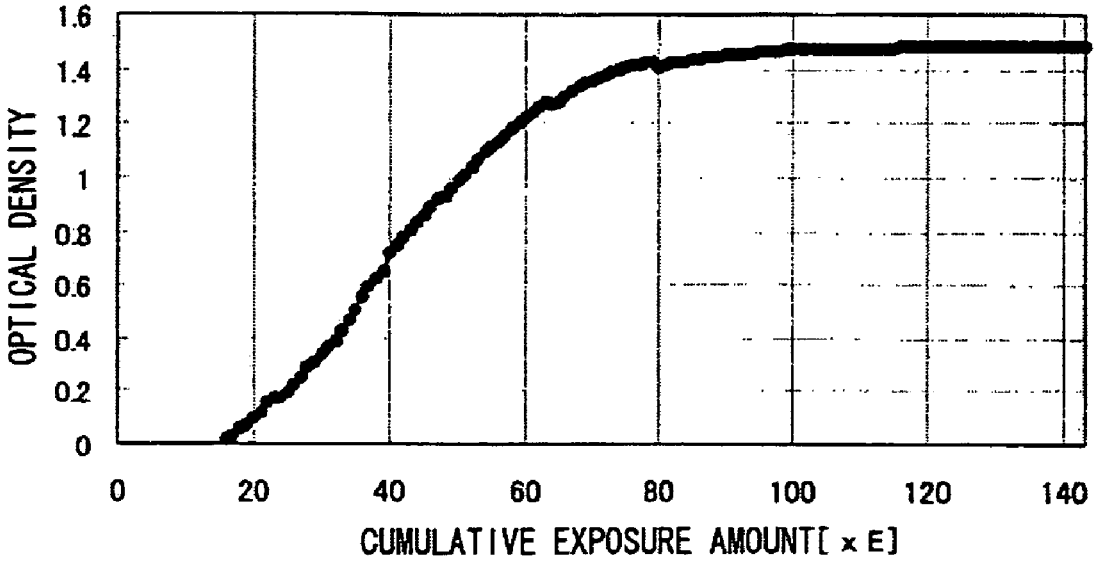
FIG. 8(*a*) is a graph showing a relation example between a cumulative exposure amount and an optical density resulted from simulation of the printing apparatus.
Figure 8B:
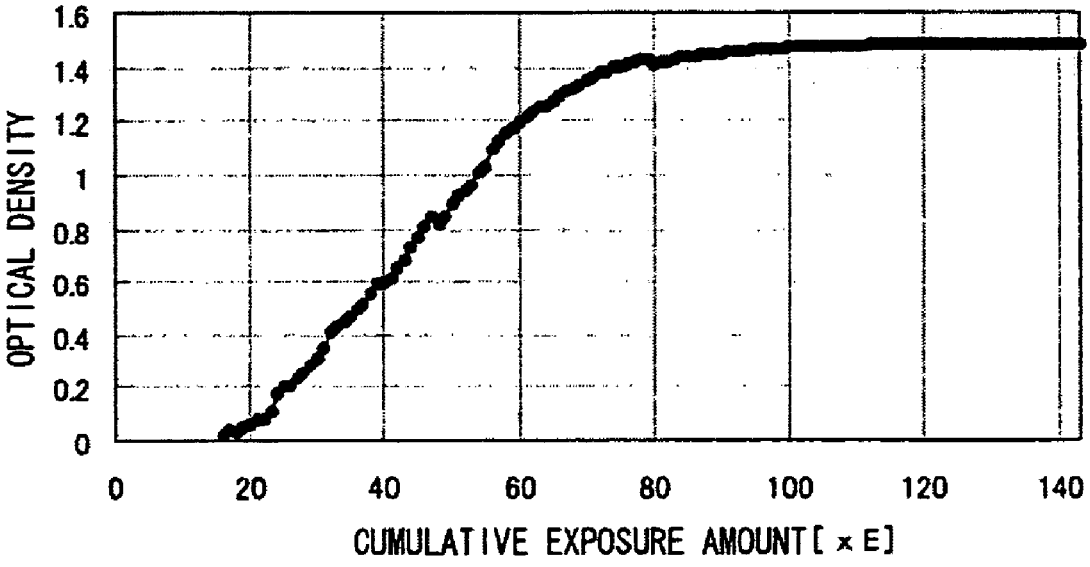
Figure 8C:
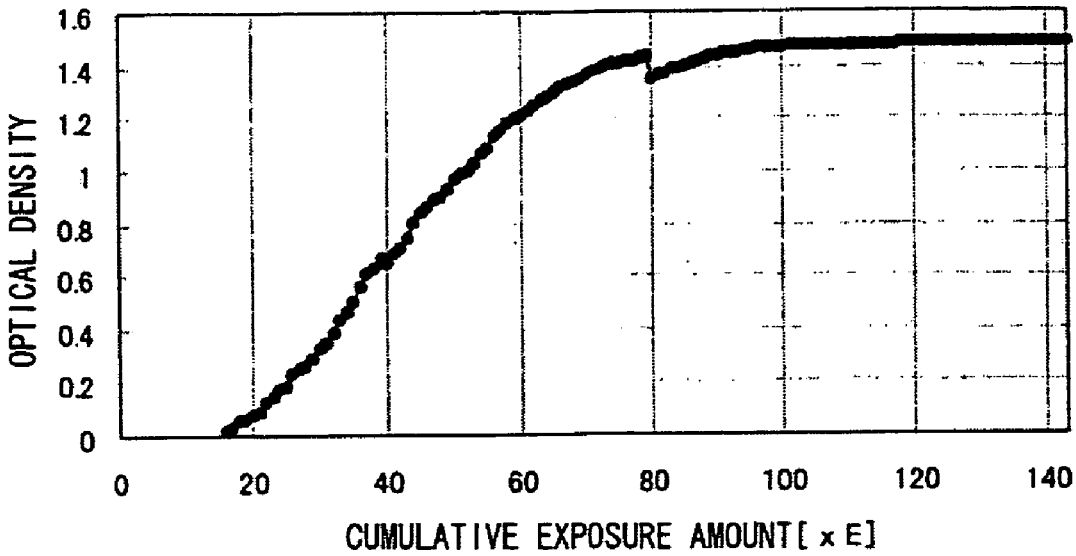
Figure 8D:
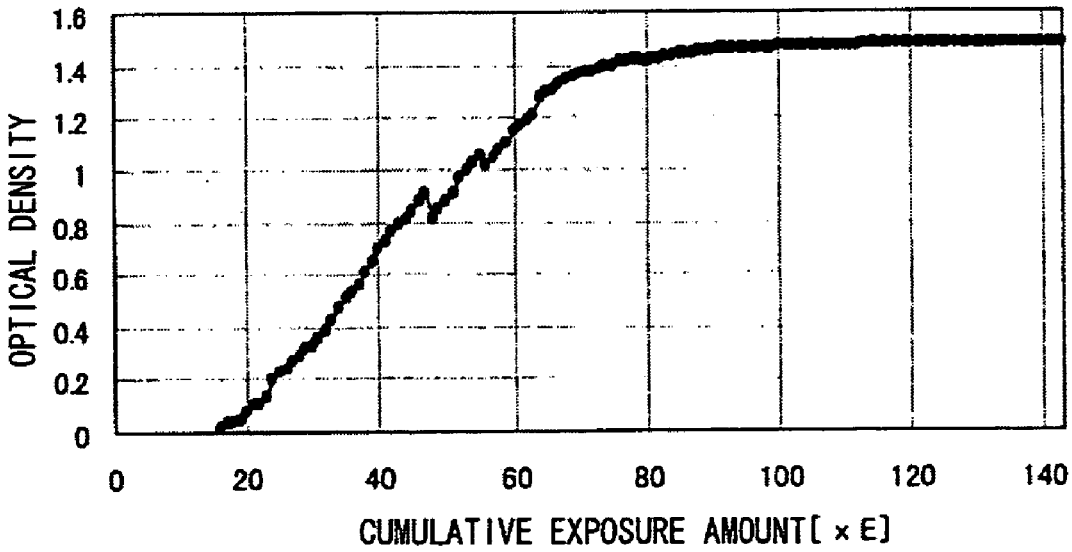

FIG. 7 is shows a typical light-emission status of the LED element as generating according to the image data and the driving pattern data shown in FIG. 6, in association with relation to waveforms of an m-line synchronization signal and a strobe signal. A typical spot diameter illustrated in FIG. 7 expresses only a mutual magnitude relation. The printing apparatus renders based on the driving pattern data PTN the LED elements emit the light by a pulse width of the strobe signal, i.e., only for the time set in the strobe time registers STBR1 to STBR8.

FIGS. 8(*a*) to 8(*d*) show one example of the optical density of the image formed through a development process conducted upon exposure of the photosensitive drum, resulted from simulation as described below. Only one luminous point is handled for the sake of simplicity in this simulation. FIG. 14 shows a list of values assigned to the strobe time registers STBR1 to STBR8 to obtain the graphs shown in FIGS. 8(*a*) to 8(*d*). In the printing apparatus, the exposure time as a base is set in the strobe time register STBR8 since stable fixation of the toner generally requires a certain level of the exposure. That is, the value to be set tin the strobe time register STBR8 is determined such that one of the strobe signals determines the smallest exposure amount required for attachment of the toner with a predetermined density upon exposure of the photosensitive drum 1. Thus, the exposure pattern is adjusted with 7 bits represented by the other strobe time registers STBR1 to STBR7 in this embodiment.

Figure 9:
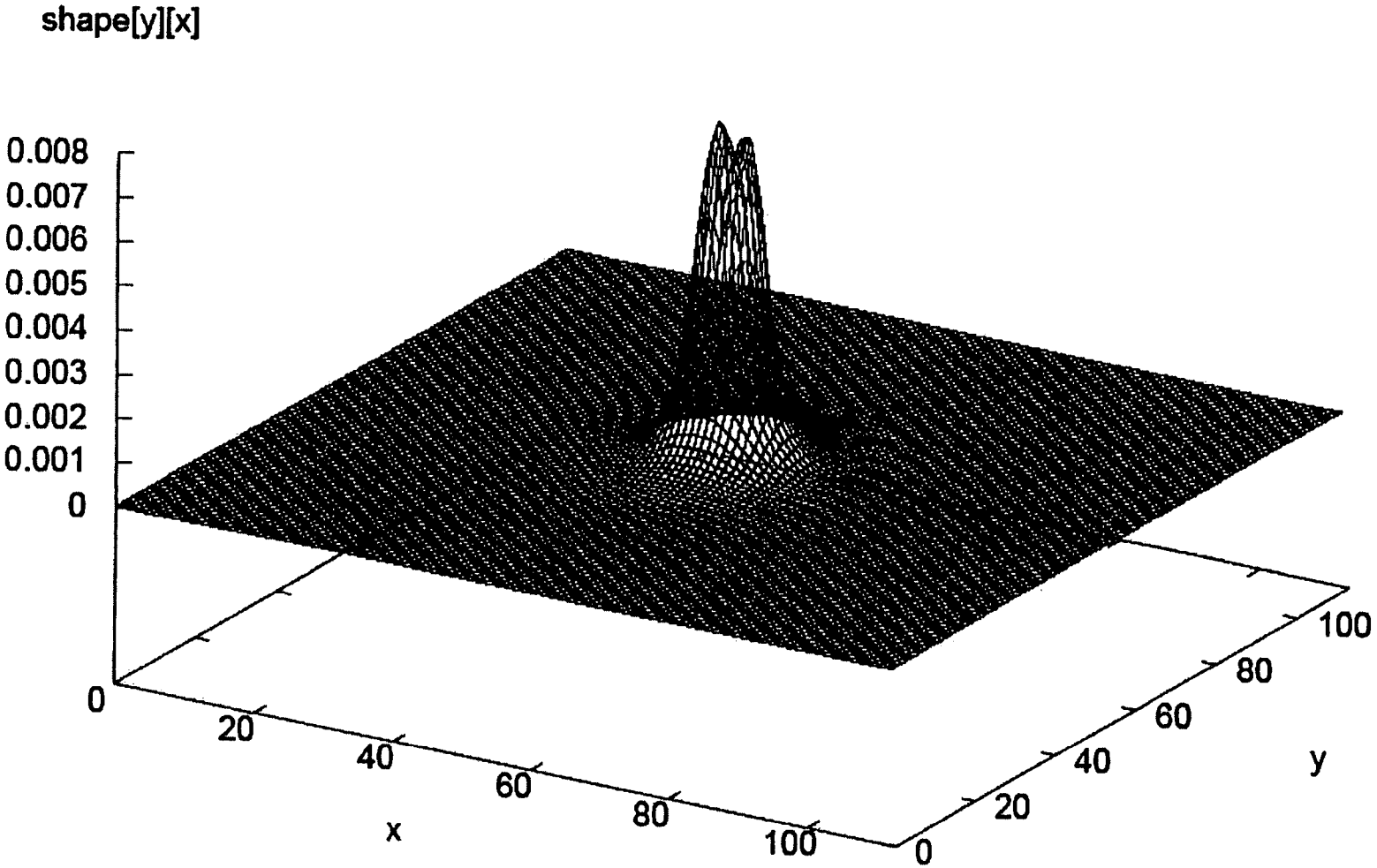
FIG. 9 is a view showing an example of a luminous intensity distribution of an LED element resulted from simulation of the printing apparatus.

Luminous energy of each LED element was measured to obtain an intensity distribution thereof and the obtained intensity distribution was stored in a two-dimensional array shape [y] [x] in this simulation. In this bout, the intensity distribution shape [y] [x] was standardized to set the sum total thereof to be 1.0. The intensity distribution shape [y] [x] such as described above is expressed as shown in FIG. 9, for example.

Figure 10:
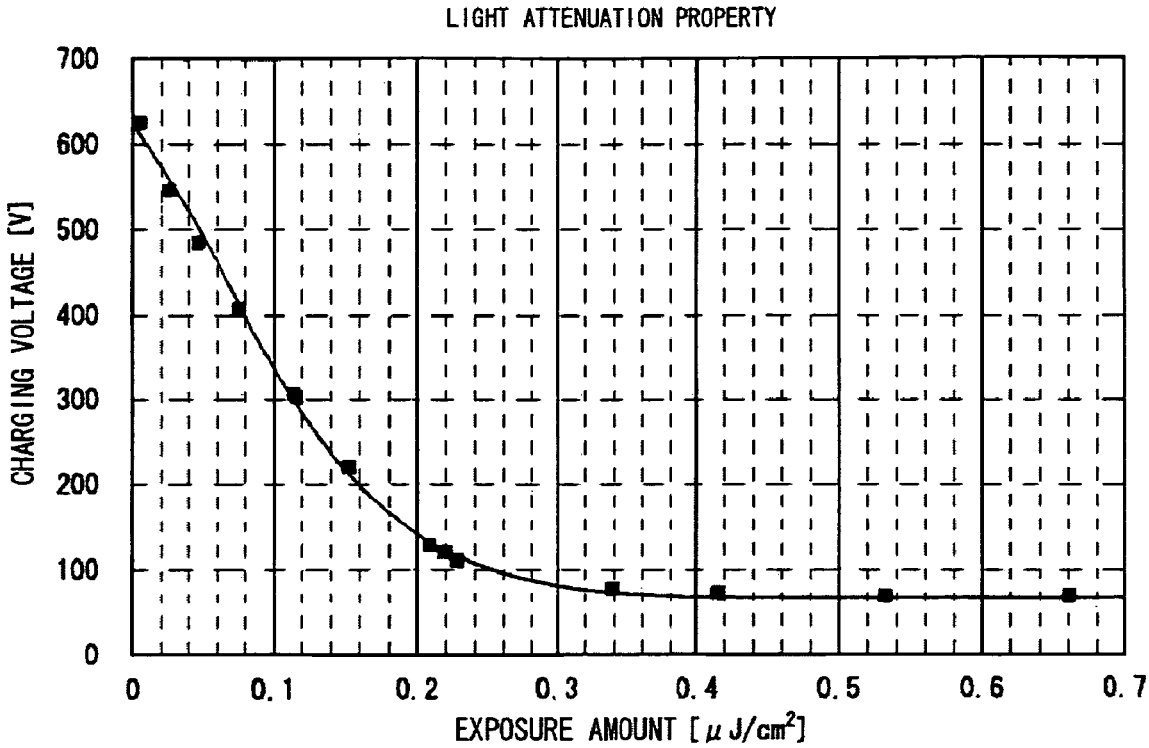
FIG. 10 is a graph plotting a charging voltage of a photosensitive drum with each of the plurality of exposure amounts.
Figure 11:
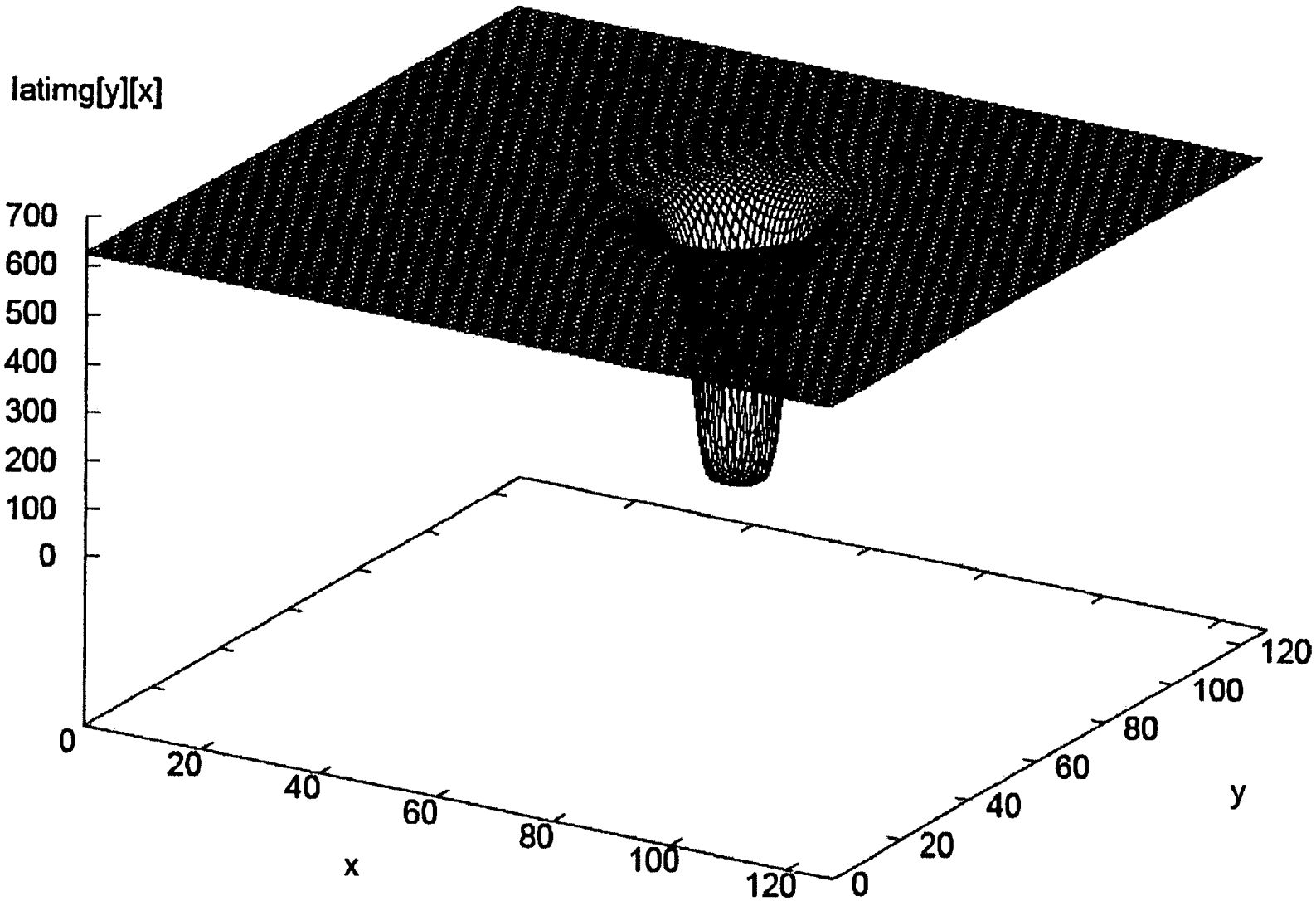
FIG. 11 is a view showing an example of an electrostatic latent image resulted from simulation of the printing apparatus.

Subsequently, an array latimg [y] [x] indicative of the electrostatic latent image at the time of light emission of the LED element with energy ES was determined upon substituting each value of the strength distribution [y] [x] in a characteristic equation of the photosensitive drum, expressed by the following equation (2) in this simulation. To determine the equation for approximating a light attenuation property of the photosensitive drum, for example, the photosensitive drum is previously charged with an initial charging voltage Vch in an experiment and the exposure amount to the photosensitive drum is changed to measure the charging voltage of the photosensitive drum after the exposure. As shown in FIG. 10, the charging voltage of the photosensitive drum with each of the plural exposure amounts was plotted to determine the following equation (2) expressing a curved line approximating the measurement results. An electrostatic latent image latimg [y] [x] obtained in the above way is expressed as shown in FIG. 11, for example. With respect to the following equation (2), it is to be noted that an initial charging voltage is set to Vch, a saturation residual voltage is set to Vsat, the half exposure amount is set to K1, a first photoreceptor characteristic function is set to K2, and that a second photoreceptor characteristic function is set to K3.

$$latimg=(Vch-Vsat)\cdot\exp\{-1.0(ES\cdot\text{shape}/K1)^{K2}/K3\}+Vsat \quad (2)$$

Figure 12:
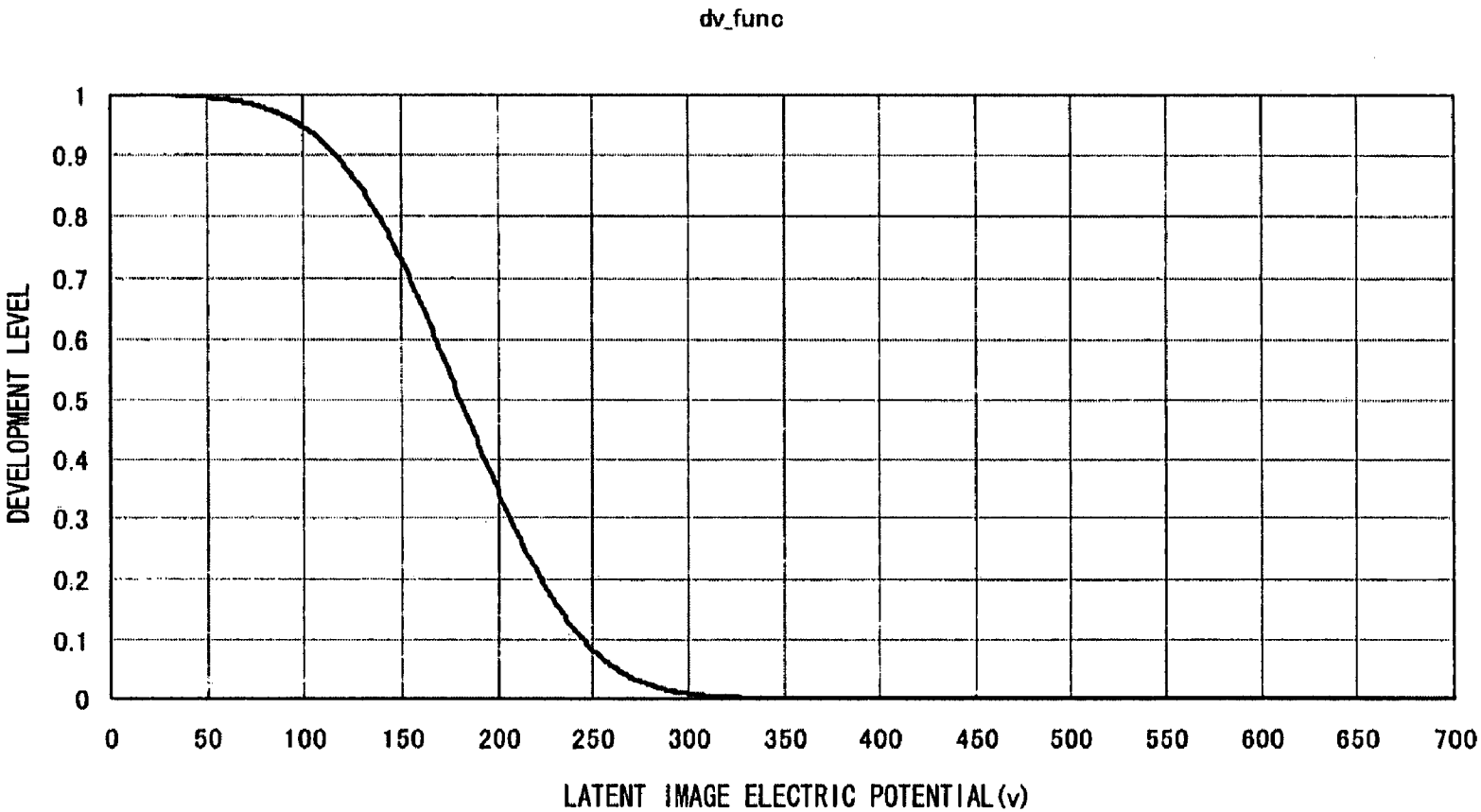
FIG. 12 is a graph showing a development function example indicative of a relation between electric potential of a photosensitive drum used for simulation of the printing apparatus and development level.
Figure 13:
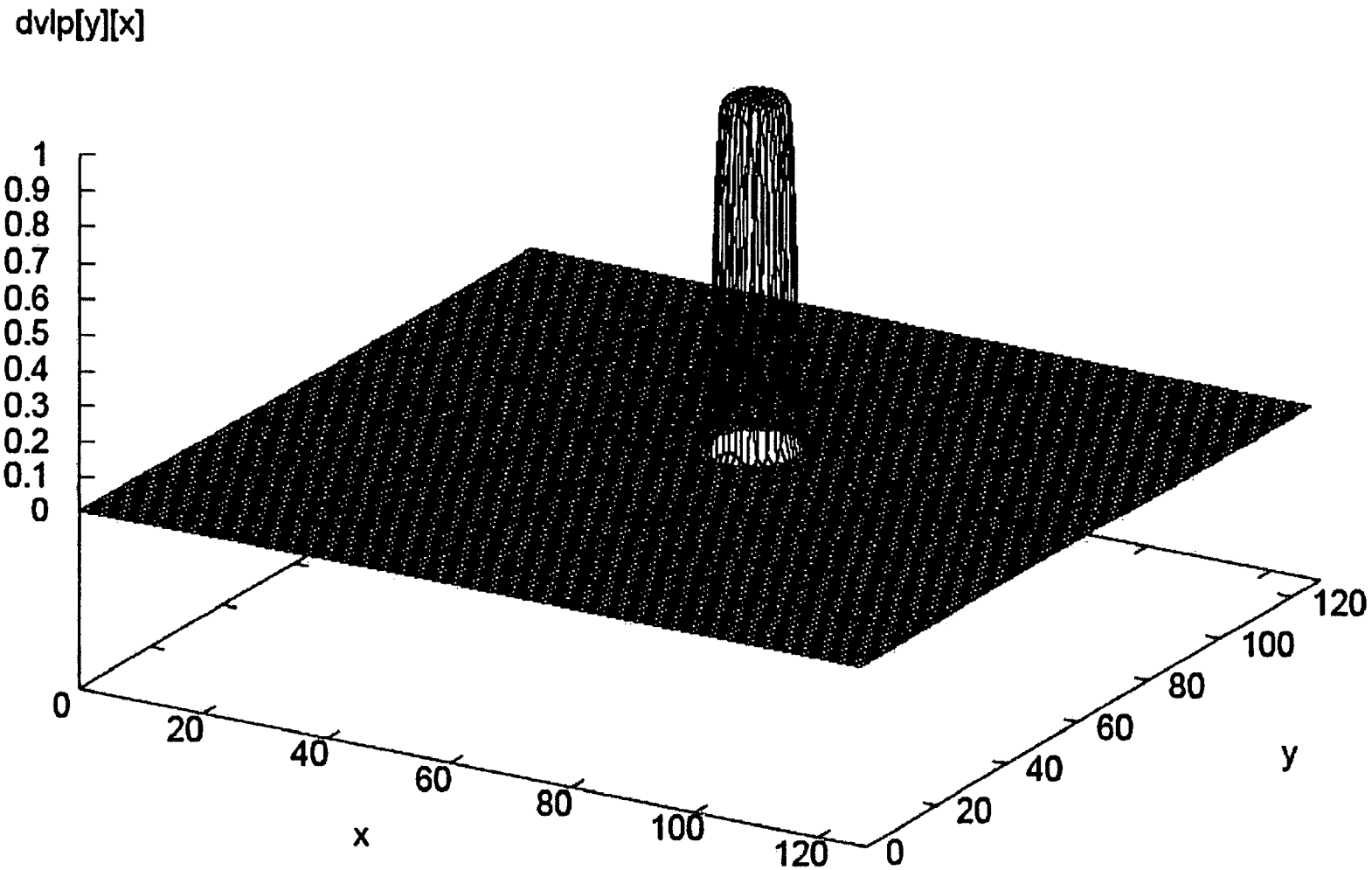
FIG. 13 is a view showing an example of a development result corresponding to electrostatic latent image resulted from simulation of the printing apparatus.

In this simulation, a development result dvlp [y] [x] corresponding to the electrostatic latent image latimg [y] [x] as a latent image potential was determined using a development function dv_func approximating a relation between the electric potential of the photosensitive drum and the development level, as shown in FIG. 12, for example. The development result dvlp [y] [x] determined in this way is expressed as shown in FIG. 13, for example. The development result dvlp [y] [x] expresses a possibility of attachment of toner per unit area, thereby being converted into an optical density od [y] [x] using the following equation (3) in the simulation. With respect to the following equation (3), Yule-Nielsen n factor is set to n whereas the maximum optical density is set to dmax.

$$od=-n\cdot\log 10\cdot\{1-dvlp\cdot(1-10^{-d\ max/n})\} \quad (3)$$

Since it is necessary to handle overlap of the eight luminous points in maximum in this embodiment, the exposure amount distributions with the 8 different energies ES(0) to ES(7) were overlapped spatially as previously shown in FIG. 7 and further, a domain (e.g., a domain of 5×5 pixels) enough to avoid a boundary condition to an unexposed location was subject to an exposure processing to obtain the optical density from the portion corresponding to a central pixel of this exposed location. For example, with respect to the exposure distribution and the arrangement of each energy at the time of irradiation of each energy previously determined in an experiment, the spatially overlapping domain was reduced in area and further, the exposure amount of the spatially overlapping domain was determined in consideration of the sum of the plurality of the exposure amounts.

Herein, the graphs previously shown in FIGS. 8(*a*) to 8(*d*) show a relation between the cumulative exposure amount and the optical density in a case where the assignment of eight different values set in the strobe time registers STBR1 to STBR8 is set to values in each of lines shown in FIG. 14(*a*) to 14(*b*), as described above. To be more specific, on the condition that a unit set time set in each of the strobe time registers STBR1 to STBR8 is set to T, FIG. 8(*a*) shows a relation between the cumulative exposure amount and the optical density in a case where values set in the strobe time registers STBR1 to STBR8 are respectively set to $4(=2^2)\times T$, $8(=2^3)\times T$, $64(=2^6)\times T$, $32(=2^5)\times T$, $16(=2^4)\times T$, $1(=2^0)\times T$, $2(=2^1)\times T$, and $16(=2^4)\times T$. FIG. 8(*b*) shows a relation between the cumulative exposure amount and the optical density in a case where values set in the strobe time registers STBR1 to STBR8 are respectively set to $16(=2^4)\times T$, $8(=2^3)\times T$, $64(=2^6)\times T$, $2(=2^1)\times T$, $4(=2^2)\times T$, $32(=2^5)\times T$, $1(=2^0)\times T$, and $16(=2^4)\times T$. FIG. 8(*c*) shows a relation between the cumulative exposure amount and the optical density in a case where values set in the strobe time registers STBR1 to STBR8 are respectively set to $64(=2^6)\times T$, $4(=2^2)\times T$, $32(=2^5)\times T$, $1(=2^0)\times T$, $16(=2^6)\times T$, $8(=2^3)\times T$, $2(=2^1)\times T$, and $16(=2^4)\times T$. FIG. 8(*d*) shows a relation between the cumulative exposure amount and the optical density in a case where values set in the strobe time registers STBR1 to STBR8 are respectively set to $1(=2^0)\times T$, $4(=2^2)\times T$, $16(=2^4)\times T$, $64(=2^6)\times T$, $2(=2^1)\times T$, $32(=2^5)\times T$, $8(=2^3)\times T$, and $16(=2^4)\times T$.

As described above, with the printing apparatus, the optical density of the development result changes according to the assignment of the values even under the condition of the same accumulative exposure amount. Thus, it is clear from the above that the values set in the strobe time registers STBR1 to STBR8 affect the quality of the linear tone reproduction curve.

In the meanwhile, FIGS. 8(*a*) to 8(*d*) show only results corresponding to 4 patterns of assignment as the assignment of values set in the strobe time registers STBR1 to STBR8 whereas 5040 patterns exit in total in this embodiment. Herein, the following equation (4) defines an index value LNR for evaluation of a relation between the assignment of values set in those strobe time registers STBR1 to STBR8 and the quality of the linear tone reproduction curve. With respect to the following equation (4), it is to be noted that value od (n) is defined as the optical density in which the maximum optical density is set to 1.0, value comb is defined as identifying information (0 to 5039) assigned to each of 5040 patterns of value assignment, and that value m is defined as the number of different exposure amounts ($m=2^{8-1}=128$) used for a modulation of the image data. In the meanwhile, m is set to be equal to 128 since the exposure time as a base is set in the strobe time register STBR8 and the exposure pattern is adjusted with the other 7 bits.

$$LNR(comb)=\sqrt{\sum_{n=0}^{m-3}[\{(od(n+2)-od(n+1))-(od(n+1)-od(n))\}^2]/(m-2)} \quad (4)$$

Figure 15:
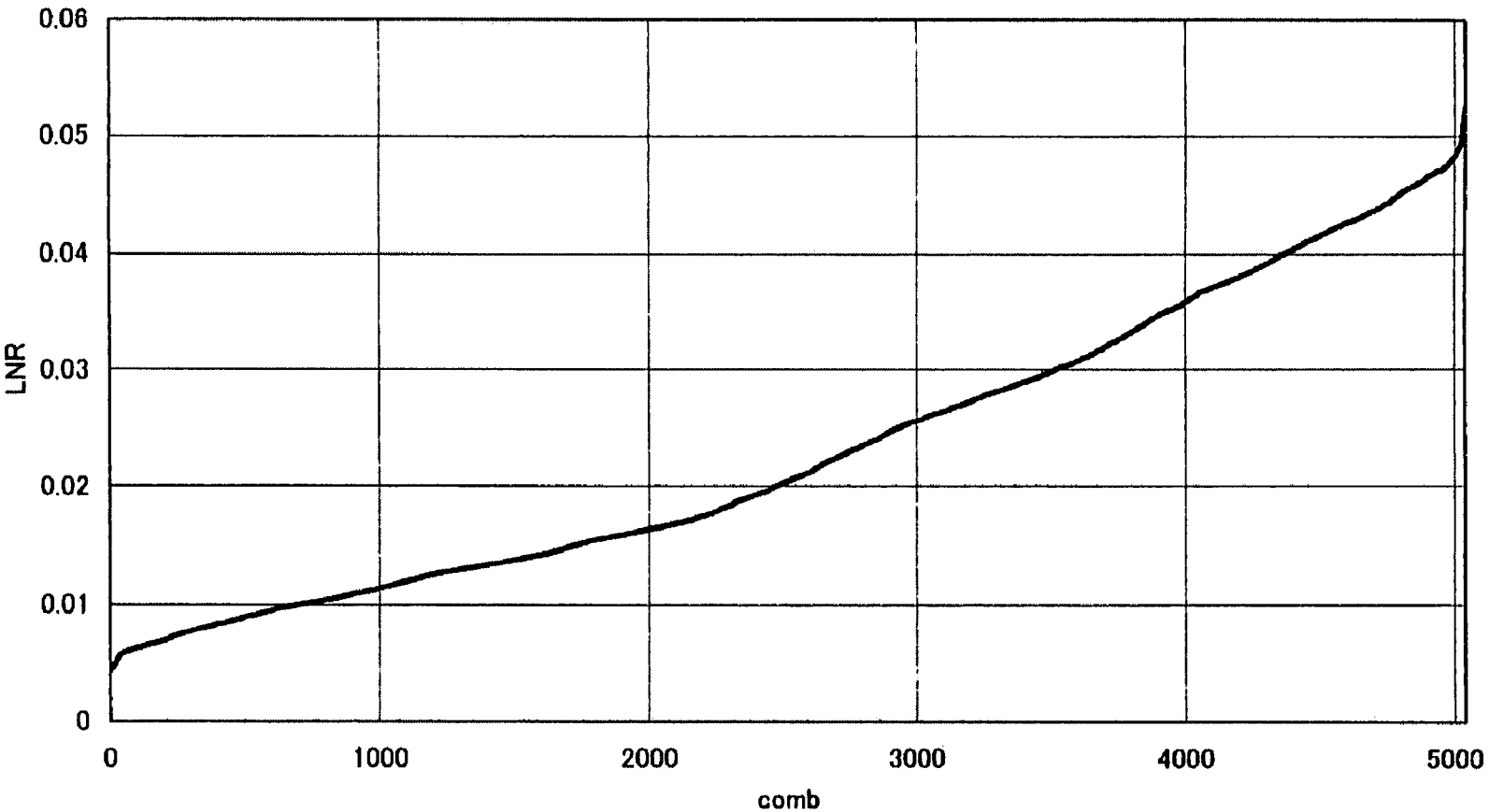
FIG. 15 is a graph showing a result of determining index values corresponding to different assigned values of 5040 numbers set in the strobe time register.

FIG. 15 shows a result of determining the index value LNR to each of 5040 patterns of value assignment. As is clear from FIG. 15, the index value LNR changes according to assignment of value in 5040 patterns, and the minimum value thereof provides the best index value. With the printing apparatus, the best linear tone reproduction curve can be realized by arranging each of eight exposed locations for expressing the tone of one pixel at a location at which the summation of difference of such the optical density is set to the minimum, as obtained based on the adjacent exposure patterns with respect to each of the 128 exposure patterns. FIGS. 8(*a*) to 8(*d*) respectively show relation examples between the cumulative exposure amount and the optical density for the $1^{st}$, $1000^{th}$, $2000^{th}$, and $3000^{th}$ times in order shown in FIG. 15, and the arrangement of light spots previously shown in FIG. 7 is corresponding to FIG. 8(*a*) which provides the best index. With the printing apparatus, the good linear tone reproduction curve can be realized by arranging the exposed location in a manner to meet the condition that the index value LNR is set to smaller than or equal to 2/m approximately equal to 0.015, at least.

As described above, with the printing apparatus according to the first embodiment, the good linear tone reproduction curve can be realized by setting a relative position of the exposed locations in consideration of interaction between the light spots composed of the plural types of exposure amounts forming one pixel.

Figure 16:
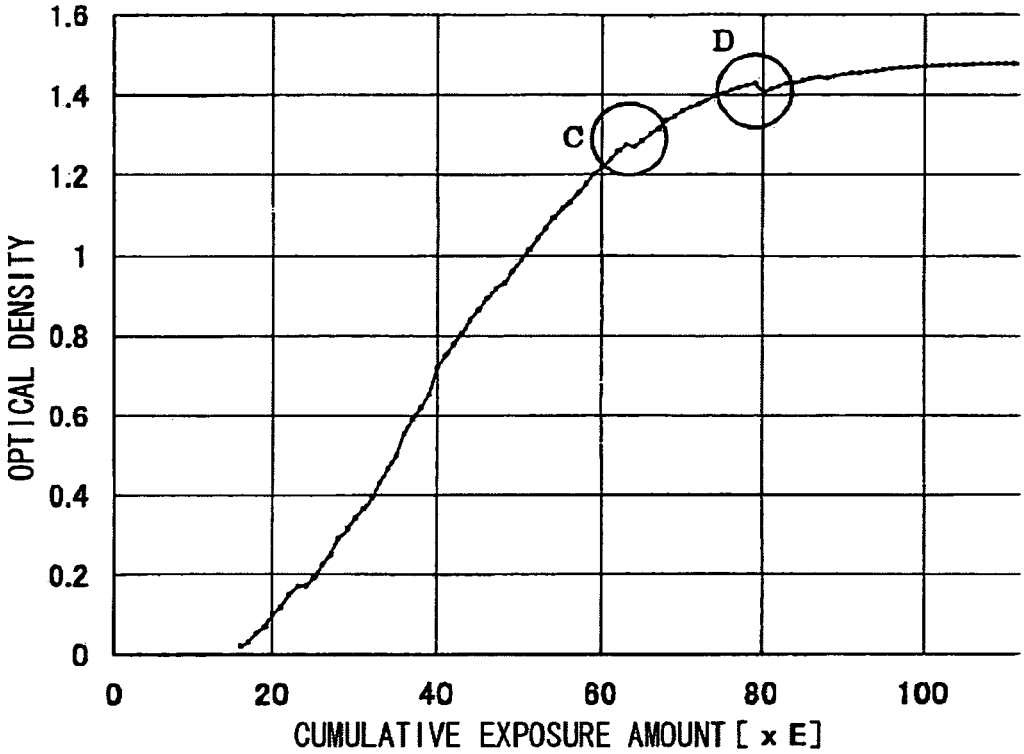
FIG. 16 is a graph showing a relation example between a cumulative exposure amount and an optical density in a case where assignment of values set in the strobe time registers is set to values in a line shown in FIG. 14(*a*)
Figure 17:
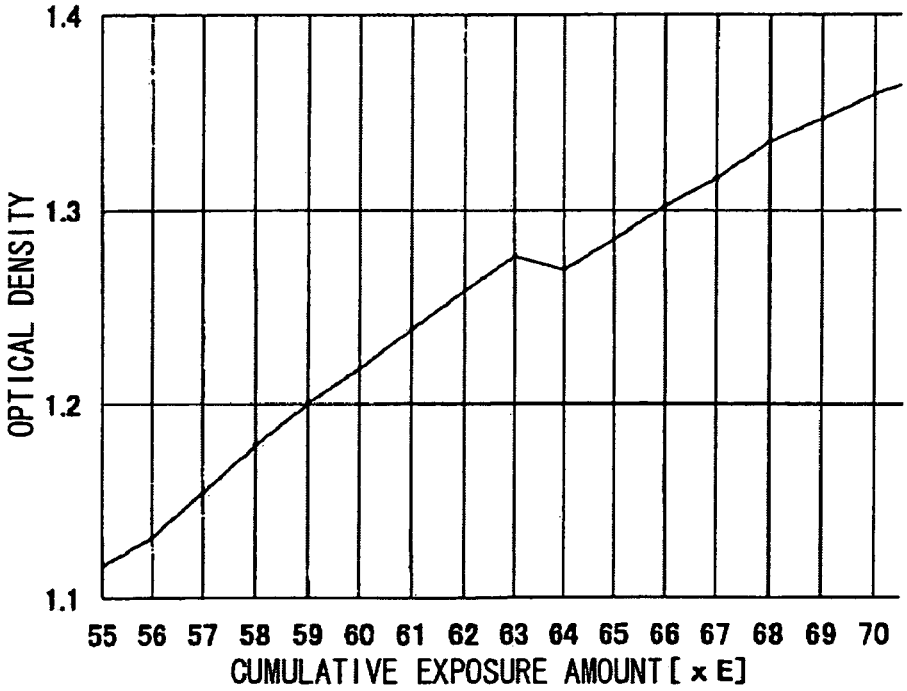
FIG. 17 is an enlarged view of a vicinity of a domain indicated by alphabet C in FIG. 16.
Figure 18:
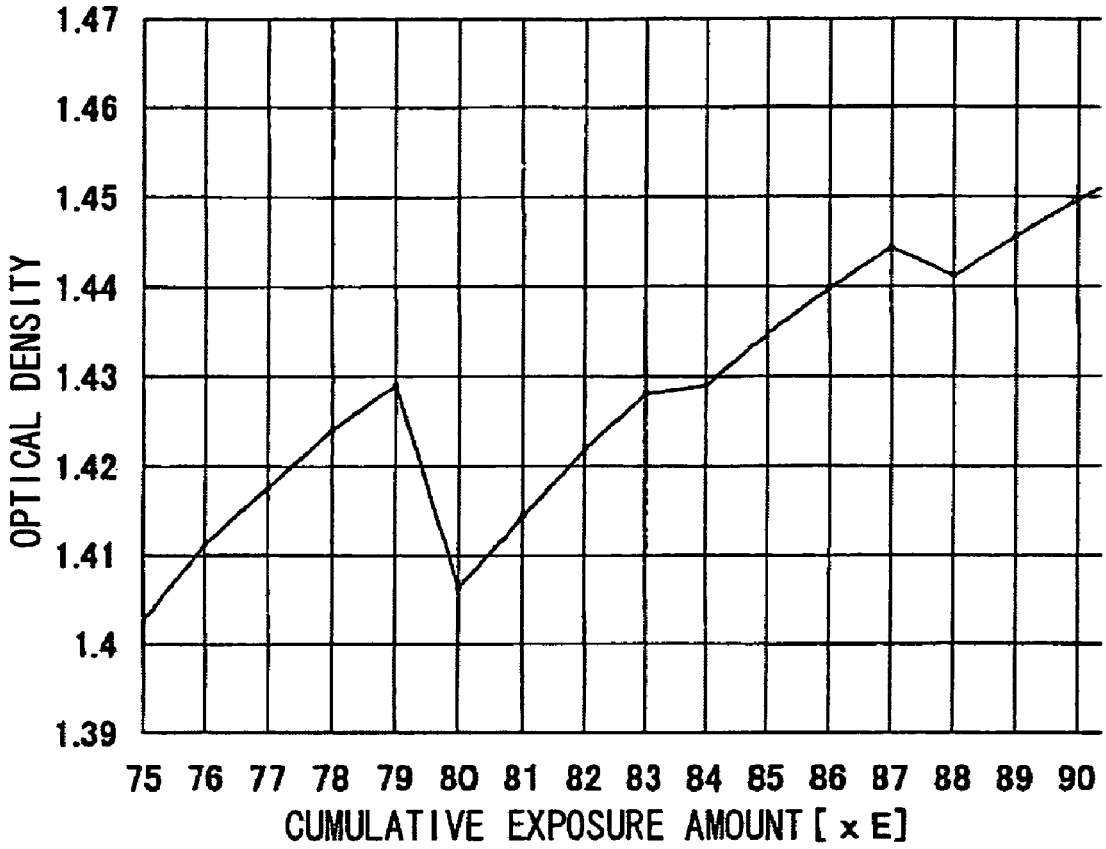
FIG. 18 is an enlarged view of a vicinity of a domain indicated by alphabet D in FIG. 16.

With the printing apparatus, however, there may be a case where the domain reverse to a relation between the image information and the tone reproduction, such as the domain indicated by alphabets C, D in FIG. 16 appears even where such the good linear tone reproduction curve as previously shown in FIGS. 8(*a*) to 8(*d*) can be realized. In the meanwhile, the graph shown in FIG. 16(*a*) shows a relation between the cumulative exposure amount and the optical density in a case where the assignment of eight different values set in the strobe time registers STBR1 to STBR8 is set to values in a line shown in FIG. 14(*a*). FIG. 17 shows an enlarged view of a vicinity of the domain indicated by alphabet C in FIG. 16. FIG. 18 shows an enlarged view of a vicinity of the domain indicated by alphabet D in FIG. 16.

FIG. 19 shows a relation between the 128 patterns of cumulative exposure amount obtained in a case where the assignment of eight different values set in the strobe time registers STBR1 to STBR8 is set to values in the line shown in FIG. 14(*a*) and the corresponding driving pattern data. In such a case, the printing apparatus can correct upon substitution of the exposure pattern as described below, the effect due to such as reverse that the optical density decreases as opposed to increase of the cumulative exposure amount.

With the printing apparatus, an optical density property to the cumulative exposure amount is determined first as shown in FIGS. 8(*a*) to 8(*d*).

Where the optical density od [n] decreases less than the optical density od [n_max] upon comparison between the maximum optical density od [n_max] and the optical density od [n] of the cumulative exposure amount [n] in a range of the cumulative exposure amount from the small amount [0] to [n], such the driving pattern table is generated that substitutes the exposure pattern for obtaining the exposure amount of the optical density od [n_max] for the exposure pattern for obtaining the exposure amount of the cumulative exposure amount [n], thereby being stored in the driving pattern table memory 52*a*.

Figure 21:
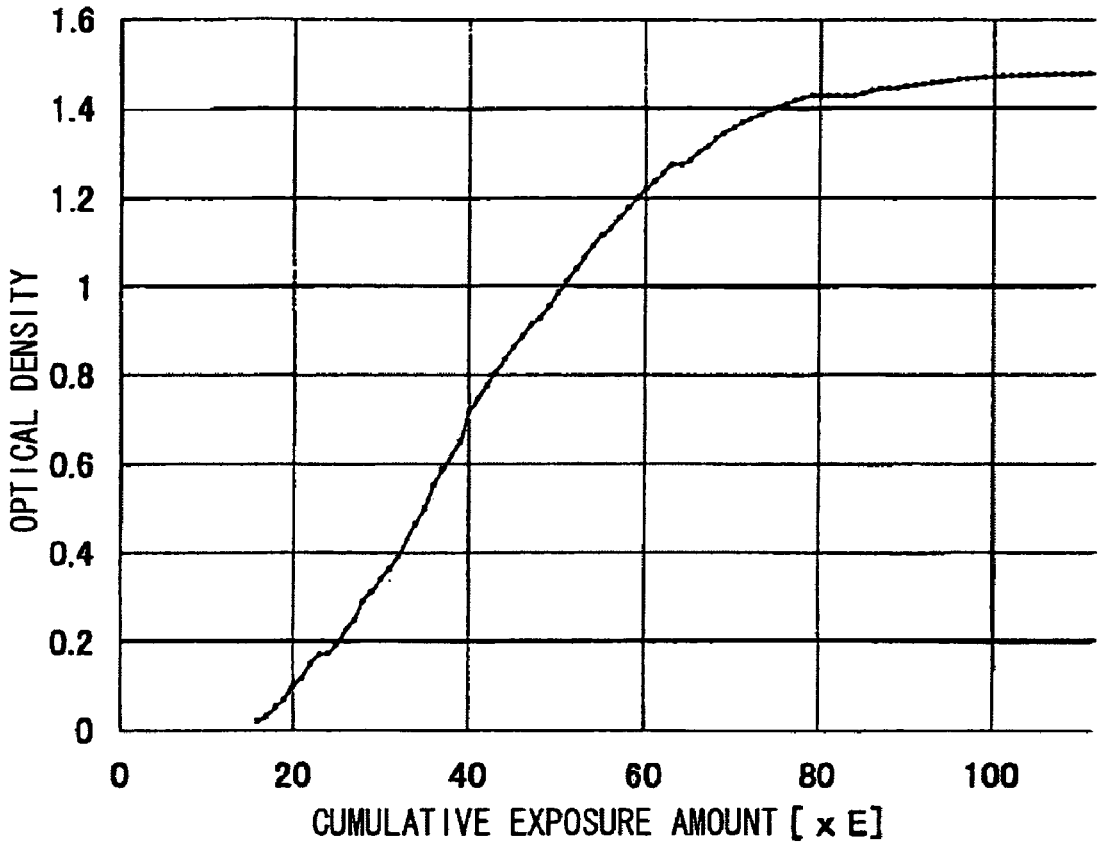
FIG. 21 is a relation example between a cumulative exposure amount and an optical density obtained with the driving pattern shown in FIG. 21.

To be more precise, the cumulative exposure amount and the driving pattern data of 128 patterns can be obtained where the driving pattern is substituted by the driving pattern having the small cumulative exposure amount and the maximum optical density, with respect to the domain at which the optical density decreases as opposed to increase of the cumulative exposure amount in the cumulative exposure amount and the driving pattern data of 128 patterns shown in FIG. 19. A relation between the cumulative exposure amount and the optical density obtained with the driving pattern shown in FIG. 20 such as obtained upon adjustment of the domain having the optical density decreasing in a case of increase of the exposure amount, as shown in FIG. 21.

As described above, with the printing apparatus, the exposure amount can be substituted by the smaller exposure amount in the domain in which the optical density decreases in a case of increase of the exposure amount, thereby being able to adjust such the domain.

The printing apparatus allowing a rough tone generates a conversion table of a light emitting pattern corresponding to the optical density as the tone value upon retrieving one part of the plurality of light emission patterns but may select the domain having the optical density monotonically increasing as opposed to the cumulative exposure amount upon avoiding the location having the optical density decreasing as opposed to increase of the cumulative exposure amount to form and store in the driving pattern table memory 52*a* the exposure pattern for obtaining the cumulative exposure amount and the driving pattern table of the optical density.

Figure 23:
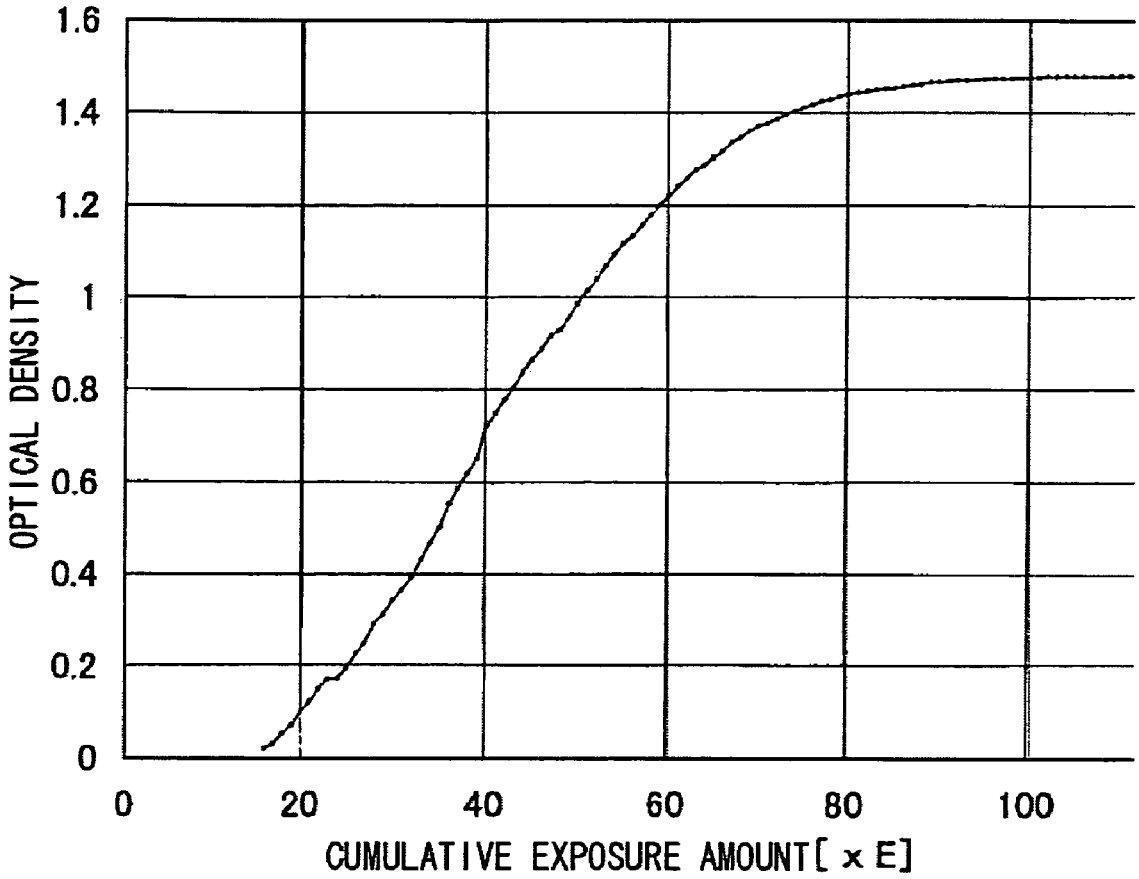
FIG. 23 is graph showing a relation example between a cumulative exposure amount and an optical density obtained with a driving pattern shown in FIG. 22.

To be more precise, the cumulative exposure amount and the driving pattern data of 128 patterns such as shown in FIG. 22 can be obtained in a case of deleting from the cumulative exposure amount and the driving pattern data of 128 patterns shown in FIG. 19, the driving pattern data of the domain having the optical density decreasing as opposed to increase of the cumulative exposure amount. A relation between the cumulative exposure amount and the optical density obtained with the driving pattern shown in FIG. 22 such as obtained upon adjustment of the domain having the optical density decreasing in a case of increase of the exposure amount, such as shown in FIG. 23.

As described above, the printing apparatus allowing the rough tone may select the domain having the optical density monotonically increasing as opposed to the cumulative exposure amount upon avoiding the location having the optical density decreasing as opposed to increase of the cumulative exposure amount to form the exposure pattern for obtaining the cumulative exposure amount and the driving pattern table of the optical density.

The printing apparatus according to the second embodiment is described next.

With the printing apparatus according to the second embodiment, a tone value per pixel is modulated based on a luminous intensity, not on the emission time of each LED element likewise the first embodiment. In the second embodiment, the elements substantially the same as those in the first embodiment are assigned with the same reference numbers so that those duplicated description are omitted.

Figure 24:
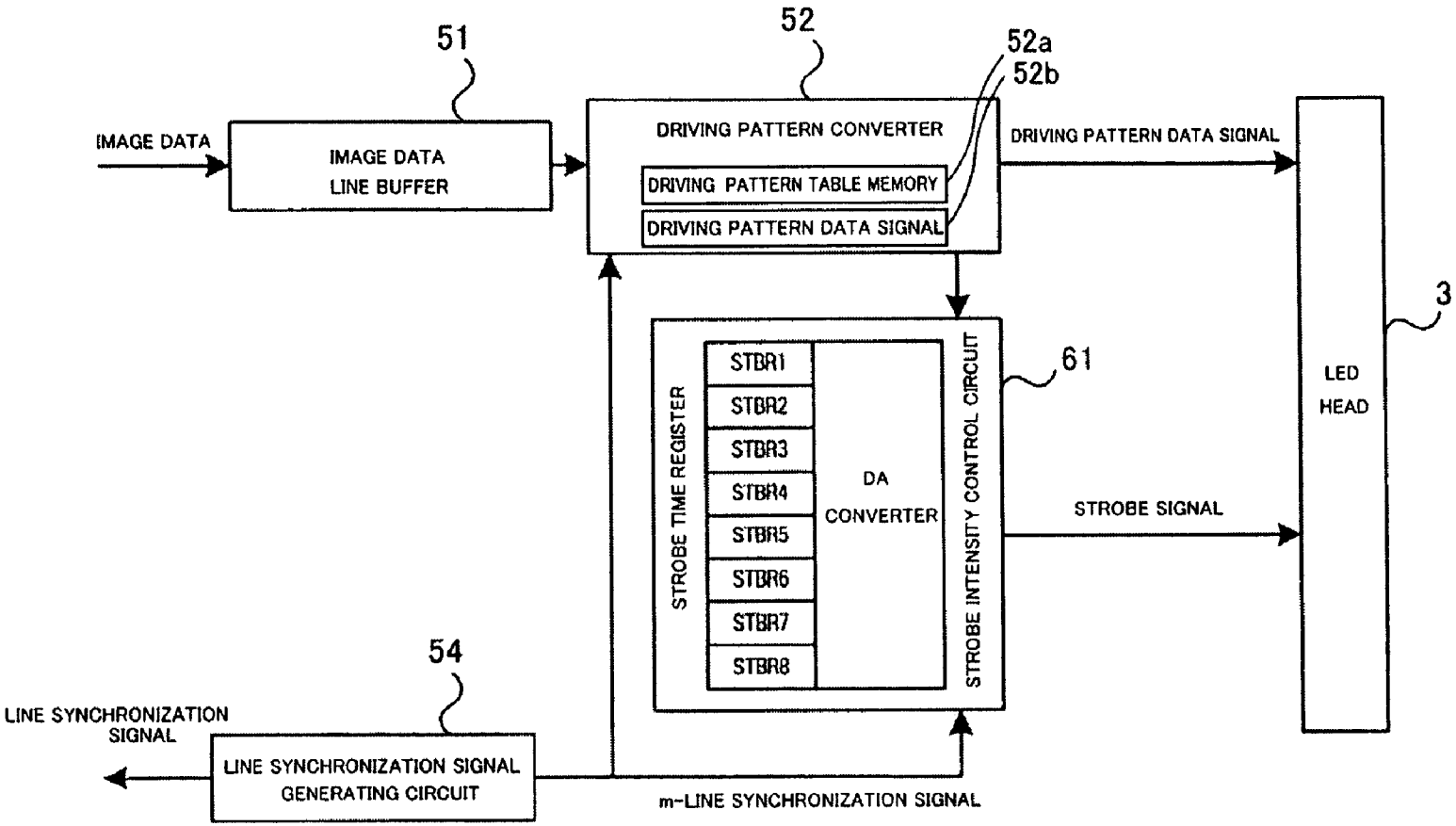
FIG. 24 is a block diagram illustrating a structure of a function performed by a controller and an LED head controller of a printing apparatus according to a second embodiment.

The printing apparatus according to the second embodiment realizes such a function as shown in FIG. 24 in using the controller 20 and the LED head controller 24.

To be more specific, the printing apparatus has a strobe intensity control circuit 61 in addition to the image data line buffer 51, the driving pattern converter 52, and the line synchronization signal generating circuit 54.

Every time the m-line synchronization signal generated by the line synchronization signal generating circuit 54 arrives, the strobe intensity control circuit 61 loads into an interior timer circuit the values set by a microcomputer, not shown, for strobe intensity registers STBR1 to STBR8 juxtaposed to the strobe time control circuit 53, and issues to the LED head 3 the strobe signal of an analog voltage level in accordance with these values.

The printing apparatus as described above outputs to the LED head 3 the strobe signal of the analog voltage level corresponding to the value set in each of the strobe intensity registers STBR1 to STBR8, based on the driving pattern data PTN to render the LED elements to emit the light with the luminous intensity corresponding to the strobe signal. That is, in this embodiment, the printing apparatus is in synchronization with the m-line synchronization signal and reads out of the driving pattern converter 52 only the most significant bit PTN[7] of the driving pattern data PIN one by another as many as the number of the LED elements to generate and issue the driving pattern data signal to the LED head 3 where the driving pattern converter 52 converts the image data per pixel based on a correspondence relation having been defined previously. Subsequently, the printing apparatus outputs the strobe signal of the analog voltage level corresponding to the value set in the strobe intensity register STBR1 from the strobe intensity control circuit 61 to the LED head 3. Furthermore, the printing apparatus is in synchronization with the subsequent m-line synchronization signal and reads out only the driving pattern data PTN[6] one by another as many as the number of the LED elements to generate and issue the driving pattern data signal to the LED head 3. The printing apparatus outputs the strobe signal of the analog voltage level corresponding to the value set in the strobe intensity register STBR2 from the strobe intensity control circuit 61 to the LED head 3. The printing apparatus completes exposure of the data corresponding to the capacity for one line of the image data line buffer 51 upon repeating execution of the above described sequence eight times.

As described above, with the printing apparatus, the tone value per pixel is modulated according to the luminous intensity of the LED element. Thus, the cumulative exposure amount per pixel is the same as that in the first embodiment, thereby being determined based on the value of the driving pattern data PTN and the values set in the strobe intensity registers STBR1 to STBR8. To be more specific, the printing apparatus realizes the exposure of 128 different patterns in total, i.e., from the first exposure pattern to the $128^{th}$ ($=2^{n-1}=2^{8-1}$) exposure pattern, as the exposure pattern of the photosensitive drum 1. It is to be noted that there are $2^{n-1}$ patterns of exposure amount since the exposure time, i.e., the time period during which the exposure is operated, defined as a base is set in the strobe time register STBR8 and the exposure pattern is adjusted with the other 7 bits. Furthermore, the printing apparatus in this embodiment is the same as that in the first embodiment as regarding the electrostatic latent image formed on the photosensitive drum 1 and further, arrangement of the light spots are also expressed as previously shown in FIG. 7.

In the printing apparatus according to this embodiment, furthermore, 5040 patterns of the value assignment exist in total as assignment of the values set in the strobe intensity registers STBR1 to STBR8 likewise the first embodiment, and the optical density changes according to the assignment of values even on the condition of the same cumulative exposure amount, so that the values set in the strobe time registers STBR1 to STBR8 effect the quality of the linear tone reproduction curve. Therefore, in the printing apparatus, the above equation (4) can define the index value LNR for evaluation of a relation between the assignment of values set in the strobe intensity registers STBR1 to STBR8 and the quality of the linear tone reproduction curve, and the minimum value provides the best index. Thus, with the printing apparatus, the best linear tone reproduction curve can be realized by arranging each of eight exposed locations for expressing the tone of one pixel at a location at which the summation of difference of such the optical density is set to the minimum, as obtained based on the adjacent exposure patterns with respect to each of the 128 exposure patterns. Furthermore, the good linear tone reproduction curve can be realized by arranging the exposed location in a manner to meet the condition that the index value LNR is set to smaller than or equal to 2/m at least.

As described above, with the printing apparatus according to the second embodiment, the good linear tone reproduction curve can be realized by setting a relative position of the exposed locations in consideration of interaction between the light spots composed of the plural types of exposure amounts forming one pixel even where the tone value per pixel is modulated based on the luminous intensity, not on the emission time of each of the LED elements.

The printing apparatus according to the third embodiment is described next.

The printing apparatus according to the third embodiment has measures against the printing operation in binary mode, in addition to having the same tone expression capacity as that in the first embodiment. Therefore, in the third embodiment, the elements substantially the same as those in the first embodiment are assigned with the same reference numbers so that those duplicated description are omitted.

The printing apparatus according to the third embodiment realizes such the function as previously shown in FIG. 3 in using the controller 20 and the LED head controller 24. Herein, the image data transmitted from the host apparatus in a case of printing in the binary mode are composed of 5 bits per pixel but only the least significant bit PIX[0] or the most significant bit PIX[31] is transmitted and the other values are not transmitted.

In the printing apparatus as described above, on the condition that the image data composed of 5 bits are set to PIX and the driving pattern data of eight times corresponding to the image data PIX are set to PTN, correspondence between the values of the image data PIX and the driving pattern data PIN is previously defined as shown in FIG. 25, for example, and the image data PIX read out of the image data line buffer 51 pixel by pixel are converted into the driving pattern data PTN. In the meanwhile, only the image data PIX[0] or PIX[31] are referred in this embodiment.

That is, where completing reception of the image data per line to store the received image data in the image data line buffer 51, the printing apparatus starts issuing the stored image data following arrival of the subsequent line synchronization signal, to the driving pattern converter 52. The driving pattern converter 52 converts the image data per pixel represented by 5 bits based on the correspondence relation previously determined as shown in FIG. 25 and stores the converted data as much as the amount corresponding to one line.

Herein, FIG. 26 shows a relation between the LED elements arranged in a main scanning direction, and the corresponding image data and the driving pattern data. Likewise the first embodiment, the printing apparatus is in synchronization with the m-line synchronization signal and reads out of the driving pattern buffer 52 only the most significant bit PTN[7] of the driving pattern data PTN one by another as many as the number of the LED elements to generate and issue the driving pattern data signal to the LED head 3. The printing apparatus subsequently outputs the strobe signal with a pulse width of the time set in the strobe time register STBR1 from the strobe time control circuit 53 to the LED head 3. Furthermore, the printing apparatus is in synchronization with the subsequent m-line synchronization signal and reads out only the driving pattern data PTN[6] one by another as many as the number of the LED elements to generate and issue the driving pattern data signal to the LED head 3. The printing apparatus outputs the strobe signal with a pulse width of time set in the strobe time register STBR2 from the strobe time control circuit 53 to the LED head 3. The printing apparatus completes exposure of the data corresponding to the capacity for one line of the image data line buffer 51 upon repeating execution of the above described sequence eight times.

As described above, the printing apparatus modulates the tone value per pixel according to the emission time of the LED element. Therefore, with respect to the cumulative exposure amount corresponding pixel by pixel, the cumulative exposure amount per pixel is determined based on a value of the driving pattern data PTN and values set in the strobe time register STBR1 to STBR8. More specifically, the printing apparatus realizes the exposure of 256different patterns in total, i.e., from the first exposure pattern to $256^{th}$ ($=2^{n}=2^{8}$) exposure pattern obtaining the different optical densities, as the exposure pattern of the photosensitive drum 1.

Figure 27:
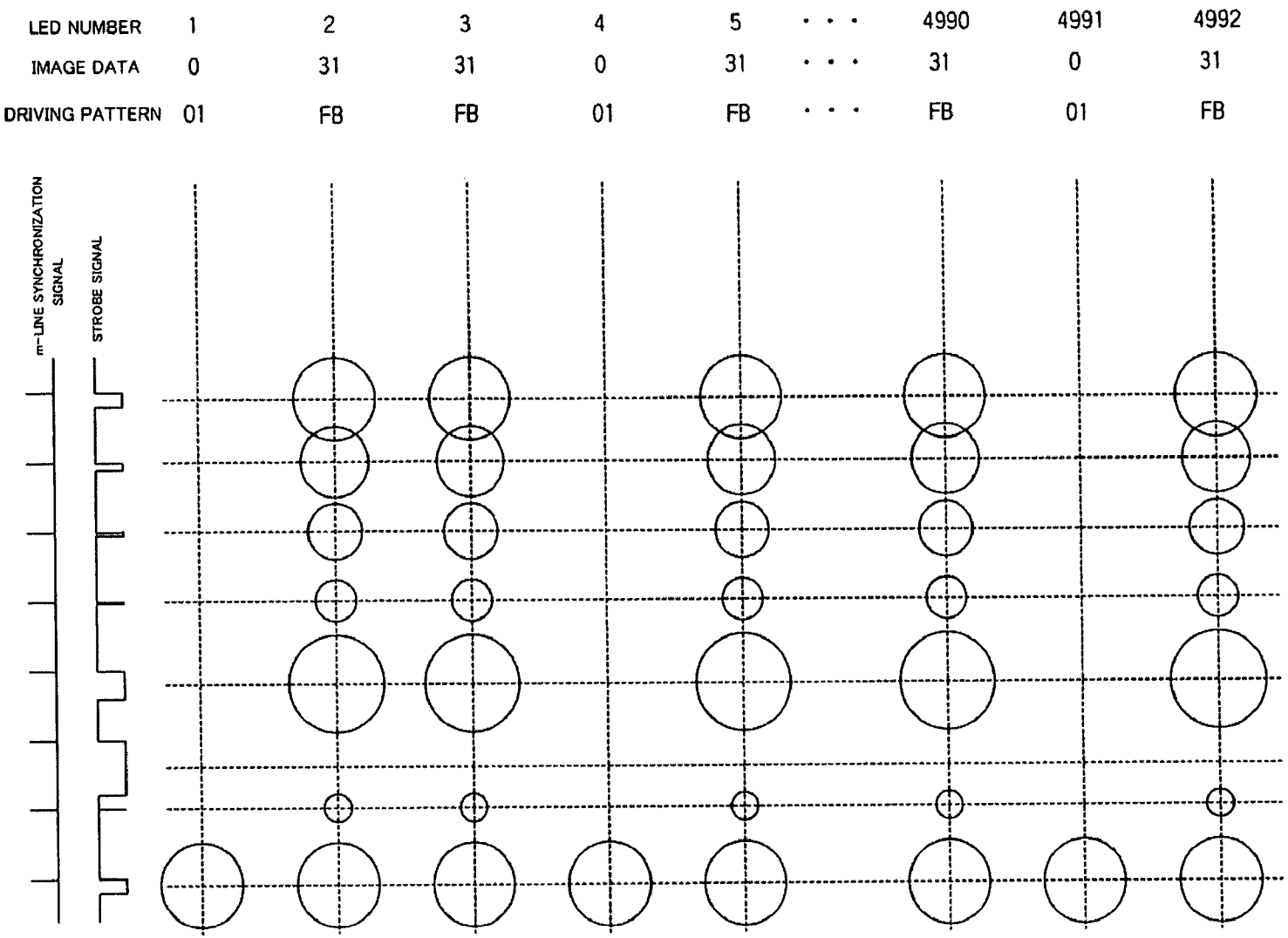
FIG. 27 shows a typical light emission status of the LED element as generating according to the image data and the driving pattern data shown in FIG. 26, in association with relations to waveforms of an m-line synchronization signal and a strobe signal.

FIG. 27 is shows a typical light emission status of the LED element as generating according to the image data and the driving pattern data shown in FIG. 26, in association with relations to waveforms of an m-line synchronization signal and a strobe signal. A typical spot diameter illustrated in FIG. 27 expresses only a mutual magnitude relation. The printing apparatus renders the LED elements to emit the light only for the time set in the strobe time registers STBR1 to STBR8 based on the driving pattern data PTN.

Figures 28, 29, 30, 31:
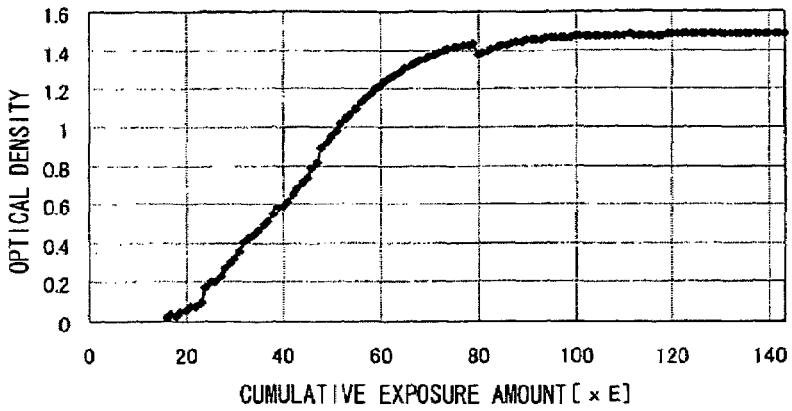
FIG. 28 is a graph showing a relation example between a cumulative exposure amount and an optical density resulted from simulation of the printing apparatus.
FIG. 29 is a table providing values set in the strobe time register, assigned to obtain the graph in FIG. 28.
FIG. 30 is a table providing assigned values set in a strobe time registers according to a fourth embodiment.
FIG. 31 is a table illustrating a relation between an LED element arrayed in a main scanning direction of the printing apparatus, and corresponding image data and driving pattern data.

FIG. 28 shows an example of such the optical density of the image formed through the development process upon exposure of the photosensitive drum 1 by the above described method, as obtained from the same simulation as that explained in the first embodiment. FIG. 29 shows a list of values set in the strobe time registers STBR1 to STBR8, assigned to obtain the graph in FIG. 28. In the printing apparatus, the exposure time as a base is set in the strobe time register STBR8 since stable fixation of the toner generally requires a certain level of the exposure. Thus, the exposure pattern is adjusted with 7 bits represented by the other strobe time registers STBR1 to STBR7 in this embodiment.

As described above, the graph in FIG. 28 shows a relation between the cumulative exposure amount and the optical density in a case where assignment of eight different values set in the strobe time registers STBR1 to STBR8 is set as shown in FIG. 29. That is, on the condition that a unit set time set in the strobe time registers STBR1 to STBR8 is set to T, FIG. 28 shows the relation between the cumulative exposure amount and the optical density in a case where values set in the strobe time registers STBR1 to STBR8 are respectively set to $16(=2^4)\times T$, $8(=2^3)\times T$, $4(=2^2)\times T$, $2(=2^1)\times T$, $32(=2^5)\times T$, $64(=2^6)\times T$, $1(=2^0)\times T$, and $16(=2^4)\times T$. It is clear from FIG. 28 that the optical density obtained with the cumulative exposure amount 79×E is defined as the large value approximately equal to that obtained with the larger cumulative exposure amount. The printing apparatus thus can operate the printing in the binary mode with the smaller cumulative exposure amount corresponding to the image data PIX[31]. It is to be noted that the arrangement of the light spots previously shown in FIG. 27 corresponds to FIG. 28 providing the best development efficiency.

The printing apparatus according to the third embodiment sets a relative position of the exposed locations having the highest occurrence density per unit of the exposure amount, based on the interaction between the light spots composed of the plural types of exposure amounts forming one pixel, thereby being able to obtain the high development efficiency as well as to aim low power consumption.

The printing apparatus according to the fourth embodiment is described next.

The printing apparatus according to the fourth embodiment is obtained upon improving the printing apparatus according to the first embodiment to deal with a case where the optical density lowers even where the cumulative exposure amount is increased. Furthermore, the printing apparatus converts the tone value into the driving pattern data such that a ratio between an entire amount of the recording energy of the image elements composing a pixel per unit and an increment of the optical density is set to greater than or equal to 0 with respect to increase of the tone value. Therefore, in the second embodiment, the elements substantially the same as those in the first embodiment are assigned with the same reference numbers so that those duplicated description are omitted.

The printing apparatus according to the fourth embodiment realizes such a function as previously shown in FIG. 3 in using the controller 20 and the LED head controller 24. Herein, on the condition that a unit set time set in the strobe time registers STBR1 to STBR8 is set to T, values set in the strobe time registers STBR1 to STBR8 are respectively set to $128(=2^7)\times T$, $64(=2^6)\times T$, $32(=2^5)\times T$, $16(=2^4)\times T$, $8(=2^3)\times T$, $4(=2^2)\times T$, $2(=2^1)\times T$, and $1(=2^0)\times T$, as shown in FIG. 30. On the condition that an exposure amount unit obtained per a set time unit T is set to E in a case of the above assignment of the strobe time registers STBR1 to STBR8, 256(0-255×E) patterns of the cumulative exposure amount are realized in total.

Herein, FIG. 31 shows a relation between 4992 LED elements arranged in a main scanning direction, and the corresponding image data of 5 bits and driving pattern data of 8 bits. In the meanwhile, the driving pattern data are to be stored in the above described driving pattern data buffer 52*b*. Furthermore, the driving pattern table memory 52*a* memorizes the driving pattern table indicative of the driving pattern corresponding to the tone value such as shown in FIG. 4.

Figure 32:
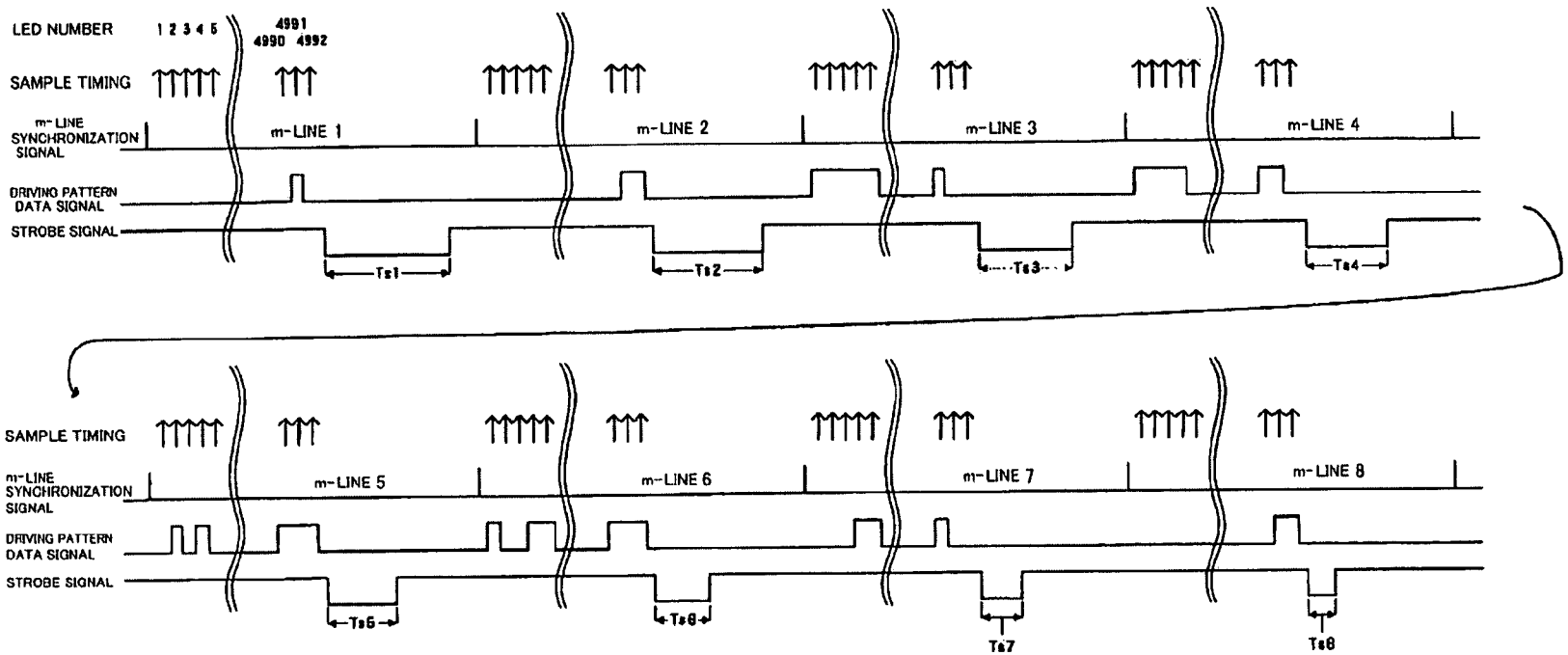
FIG. 32 is a chart illustrating timing of each signal output in a case where the driving pattern data shown in FIG. 31 are stored in a driving pattern data buffer according to the printing apparatus.

The printing apparatus is in synchronization with the m-line synchronization signal in accordance with timing shown in FIG. 32 and reads out of the driving pattern converter 52 only the most significant bit PTN[7] of the driving pattern data PTN one by another as many as the number of the LED elements to generate and issue the driving pattern data signal to the LED head 3 where the driving pattern data buffer 52*b* stores the driving pattern data shown in FIG. 31. Subsequently, the printing apparatus outputs the strobe signal with a pulse width (Ts1=128×7) of the time set in the strobe time register STBR from the strobe time control circuit 53 to the LED head 3. Furthermore, the printing apparatus is in synchronization with the subsequent m-line synchronization signal and reads out only the most significant bit PTN[6] one by another as many as the number of the LED elements to generate and issue the driving pattern data signal to the LED head 3. The printing apparatus then outputs the strobe signal with a pulse width (Ts2=64×7) of the time set in the strobe time register STBR2 from the strobe time control circuit 53 to the LED head 3. The printing apparatus completes exposure of the data corresponding to the capacity for one line of the image data line buffer 51 upon repeating execution of the above described sequence eight times.

Figure 33:
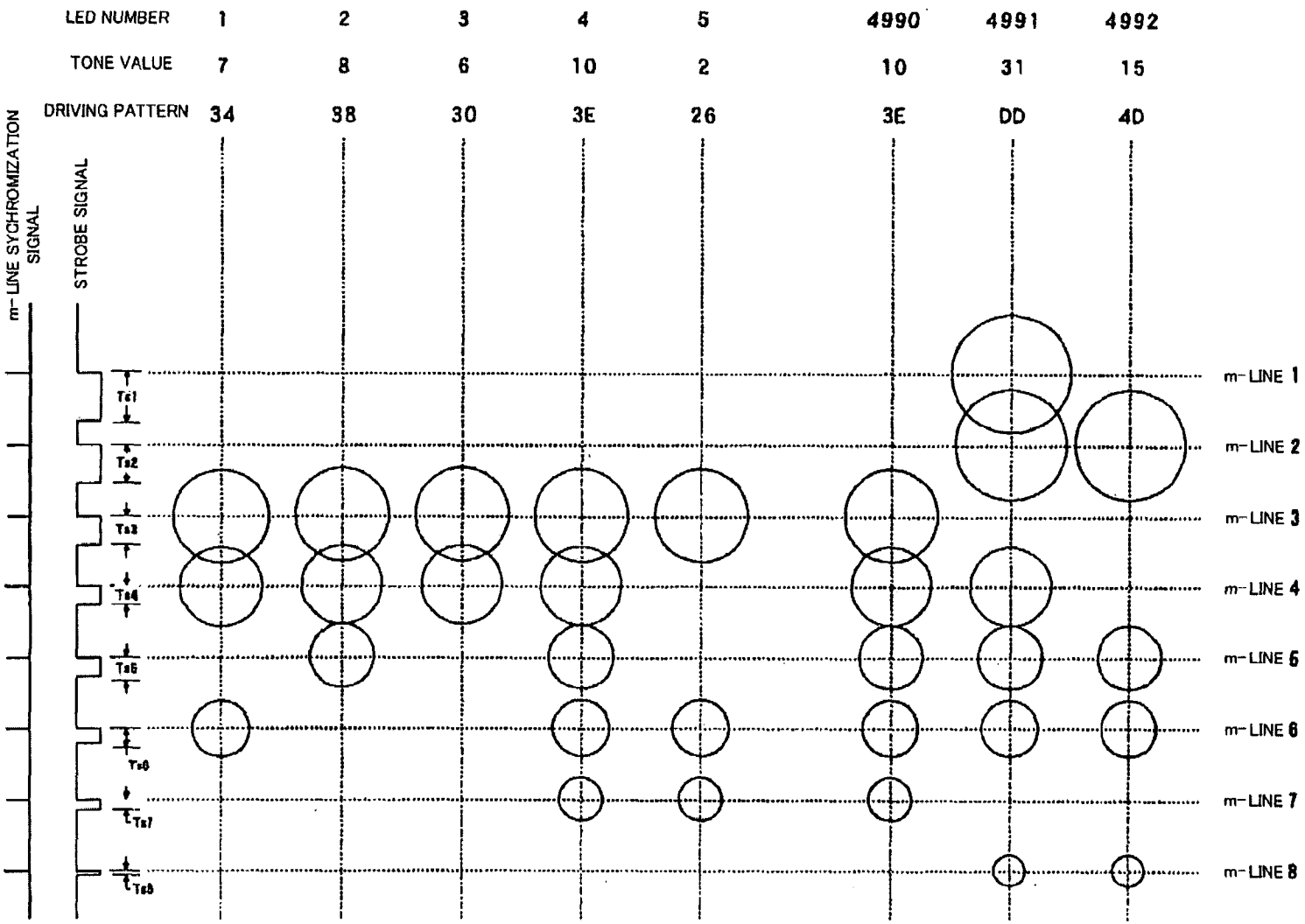
FIG. 33 shows a typical light emission status of the LED element as generating according to the image data and the driving pattern data shown in FIG. 31, in association with relations to waveforms of an m-line synchronization signal and a strobe signal.

FIG. 33 shows a typical-light emission status of the LED element as generating according to the image data and the driving pattern data shown in FIG. 31, in association with relation to waveforms of the m-line synchronization signal and the strobe signal. A typical spot diameter illustrated in FIG. 33 expresses only a mutual magnitude relation. In FIG. 33, furthermore, an interval between the m-line synchronization signals is set to one eighth of pitch 600 dpi in a main scanning direction of the LED element, i.e., pitch 4800 dpi. One pixel is configured with the driving pattern of m-lines 1 to 8.

The m-line 1 corresponds to the driving pattern data PTN[7] and the m-line 2 corresponds to the driving pattern data PIN[6]. In the same manner, the m-lines 3 to 8 correspond to the driving pattern data PTN[5] to PTN[8], respectively. The m-line 1 is exposed with a pulse width (Ts1=128×7) of the time set in the strobe time register STBR1, and the m-line 2 is exposed with a pulse width (Ts2=64×1) of the time set in the strobe time register STBR2. In the same manner, the m-lines 3 to 8 are exposed with pulse widths (Ts3=32×T, Ts4=16×T, Ts5=8×T, Ts6=4×T, Ts7=2×T, and Ts8=1×T) set in the strobe time registers STBR3 to STBR8, respectively.

As shown in FIG. 34, the printing apparatus exposes the m-lines 3, 4, 6 respectively corresponding to the driving pattern data PTN[5], [4], and [2] upon converting the tone value "7" of the LED number 1 into the driving pattern data "34hex" using the driving pattern converter 52 according to a relation between the image data represented by the tone value of 5 bits transmitted from the host apparatus to the image data line buffer 51 and the driving pattern table indicative of the corresponding driving pattern. The printing apparatus executes the exposure by rendering the LED elements emit the light based on the driving pattern data PTN, as described above.

Figure 37:
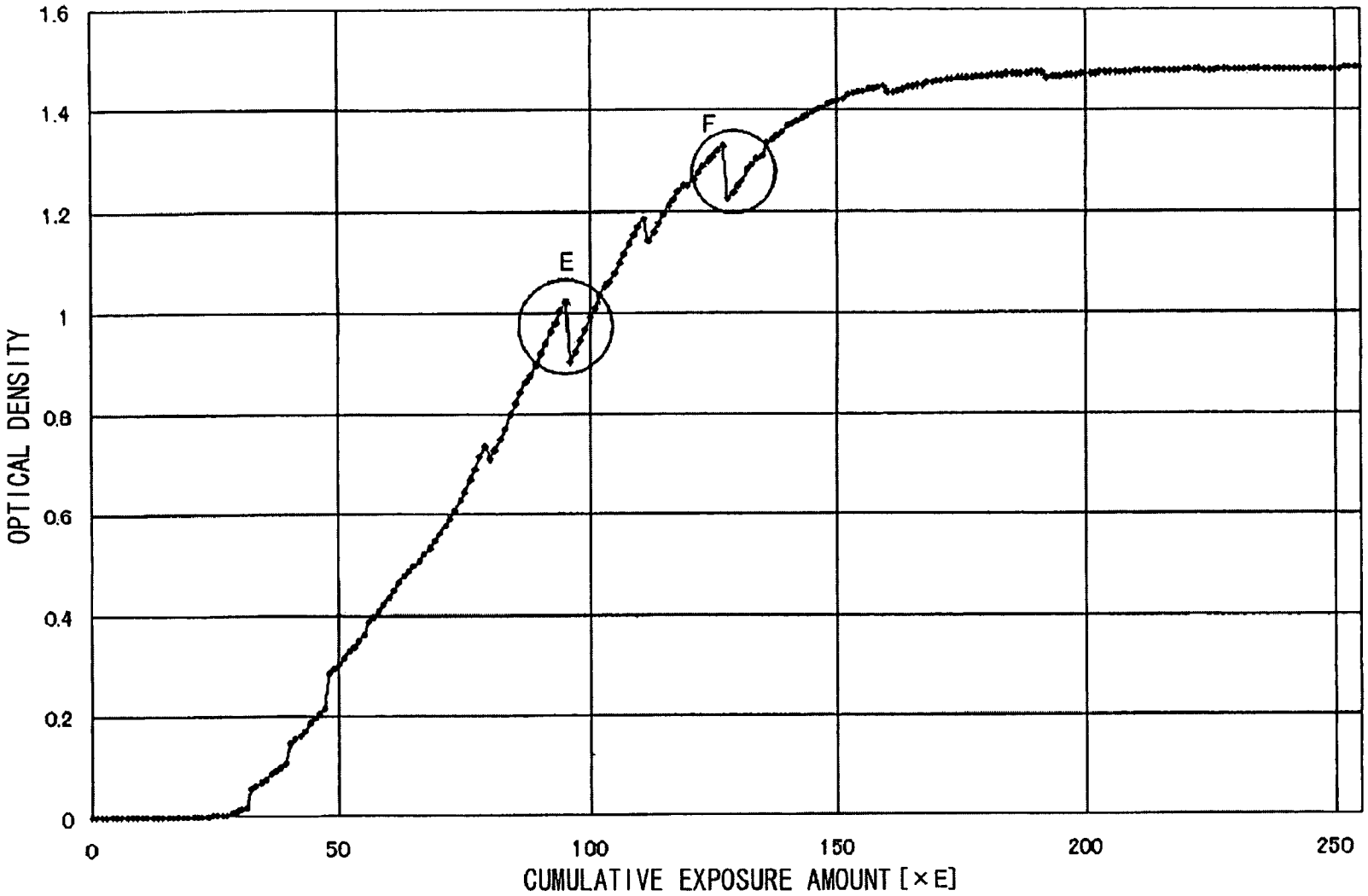
FIG. 37 is a graph illustrating a relation between the cumulative exposure amount and the optical density shown in FIG. 36.
Figure 38:
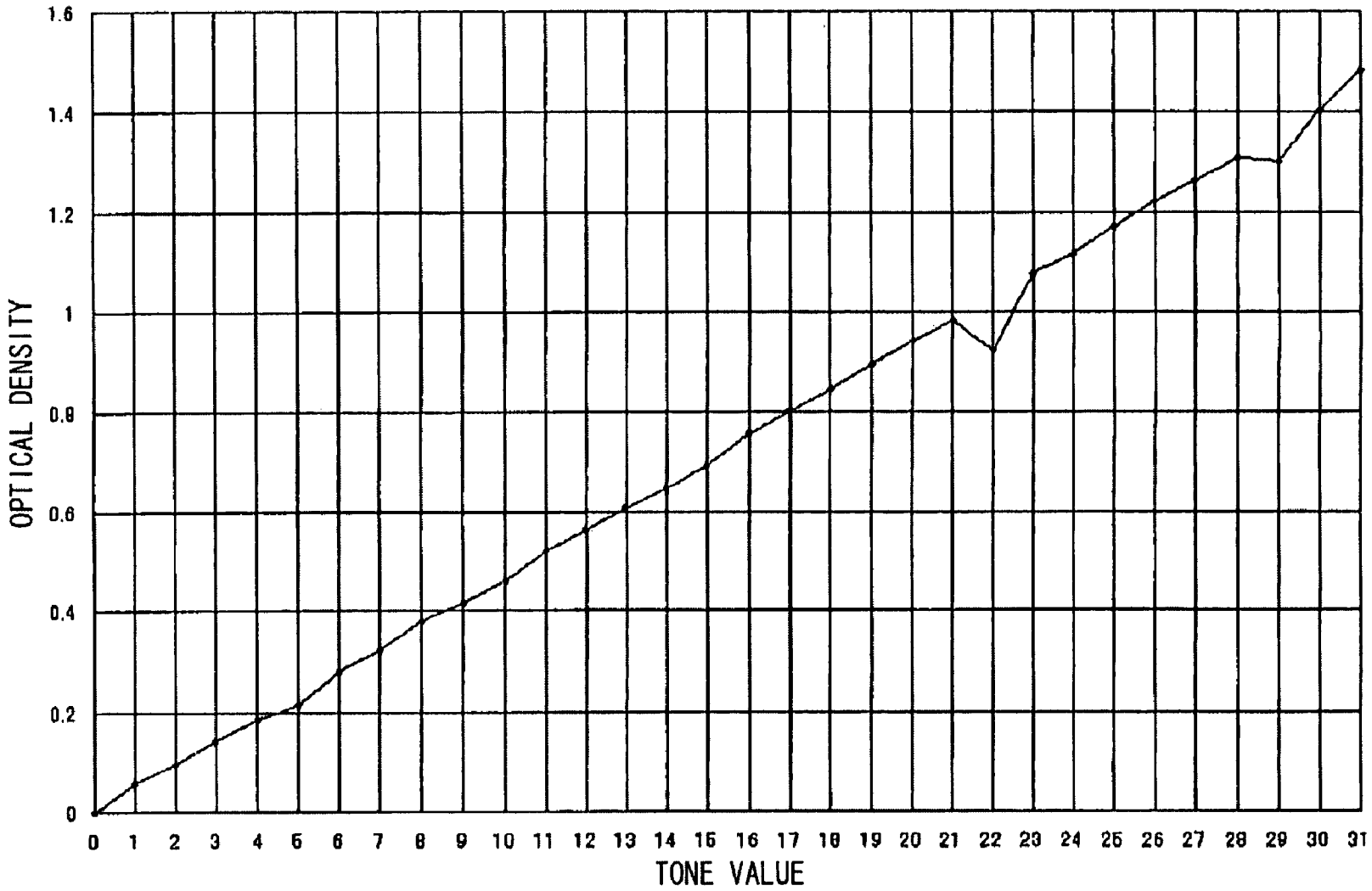
FIG. 38 is a graph illustrating a relation between a tone value and an optical density in a case where a tone value is conversed into the driving pattern based on the driving pattern table shown in FIG. 34.

Herein, FIG. 35 shows a relation between the image data represented by the tone value of 5 bits transmitted from the host apparatus to the image data line buffer 51 and the corresponding exposure amount. FIG. 36 shows a relation between the cumulative exposure amount of 256 patterns obtained according to the assignment of the strobe times shown in FIG. 30 and the driving pattern table indicative of the corresponding driving patterns. The relation between the cumulative exposure amount and the optical density of 256 patterns shown in FIG. 36 is such as shown in FIG. 37. As described above, the driving pattern shown in FIG. 36 is characterized in that the optical density decreases as opposed to increase of the cumulative exposure amount, thereby undesirably reversing to the cumulative exposure amount likewise the domain indicated by alphabets E, F in FIG. 37. Furthermore, the driving pattern table corresponding to the tone value previously shown in FIG. 34 is generated based on FIGS. 35 and 36. With the printing apparatus, such a domain undesirably appears, that the optical density decreases as opposed to increase of the tone value as shown in FIG. 38, for example, where the driving pattern converter 52 converts the tone value into the driving pattern based on the driving pattern table in a state that the driving pattern table memory 52*a* memorizes the driving pattern table as shown in FIG. 34.

Figure 40:
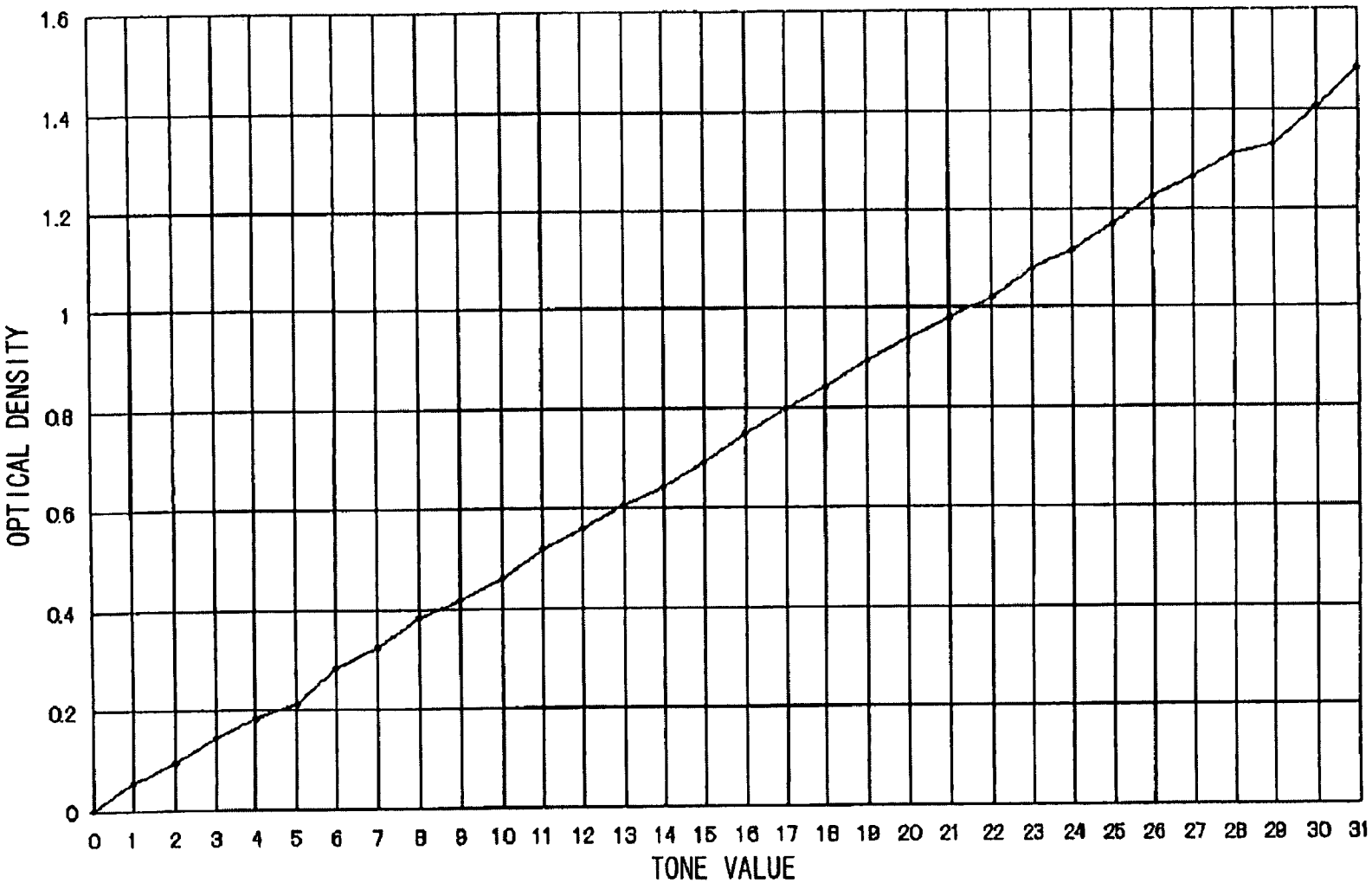
FIG. 40 is a graph illustrating a relation example between a tone value and an optical density in a case where a tone value is converted into a driving pattern based on the driving pattern table shown in FIG. 39.

The printing apparatus makes a substitution of the driving pattern with respect to the domain at which the optical density decreases as opposed to increase of the cumulative exposure amount in the cumulative exposure amount and the driving pattern data. FIG. 39 shows a relation between the cumulative exposure amount of 256 patterns obtained according to the assignment of the strobe times shown in FIG. 30 and the driving pattern table indicative of the corresponding driving patterns. The driving pattern shown in FIG. 39 differs from that previously shown in FIG. 36 in modification of the driving pattern used for the domain of the cumulative exposure amount from 96×E to 101×E indicated by alphabet E and for the domain of the cumulative exposure amount from 128×E to 135×E indicated by alphabet F in FIG. 37. Herein, the printing apparatus substitutes the driving pattern data "5Fhex" such as resulting in the smaller cumulative exposure amount 95×E with the maximum optical density for the original driving pattern data with respect to the domain of the cumulative exposure amount from 96×E to 101×E. The printing apparatus substitutes the driving pattern data "7Fhex" such as resulting in the smaller cumulative exposure amount 127×E with the maximum optical density for the original driving pattern data with respect to the domain of the cumulative exposure amount from 128×E to 135×E. In the meanwhile, the driving pattern table corresponding to the tone value previously shown in FIG. 4 is generated based on FIGS. 35 and 39. In the printing apparatus, the driving pattern table memory 52*a* memorizes the driving pattern table and then the driving pattern converter 52 converts the tone value into the driving pattern based on the driving pattern table. The printing apparatus thus can eliminate the domain at which the optical density decreases as opposed to increase of the tone value, as shown in FIG. 40.

As described above, the printing apparatus converts the tone value into the driving pattern data such that a ratio between a entire amount of the recording energy of the image element composing a pixel per unit and an increment of the optical density is set to greater than or equal to 0 with respect to increase of the tone value. In particular, the printing apparatus can realize the extremely good linear tone reproduction curve and remarkably improve the printing quality by substituting the driving pattern such as resulting in the smaller cumulative exposure amount with the maximum optical density for the original driving pattern with respect to the domain at which the optical density decreases as opposed to increase of the cumulative exposure amount in the cumulative amount and the driving pattern data.

The printing apparatus according to the fifth embodiment is finally described.

The printing apparatus according to the fifth embodiment provides another method to convert the tone value into the driving pattern data such that a ratio between a entire amount of the recording energy of the image element composing a pixel per unit and an increment of the optical density is set to greater than or equal to 0 with respect to increase of the tone value, likewise the printing apparatus according to the fourth embodiment. In the fifth embodiment, the elements substantially the same as those in the first embodiment are assigned with the same reference numbers so that those duplicated description are omitted.

The printing apparatus according to the fifth embodiment realizes such a function as previously shown in FIG. 3 in using the controller 20 and the LED head controller 24. Herein, the values set in the strobe time registers STBR1 to STBR8 are respectively set to $128(=2^7)\times T$, $64(=2^6)\times T$, $32(=2^5)\times T$, $16(=2^4)\times T$, $8(=2^3)\times T$, $4(=2^2)\times T$, $2(=2^1)\times T$, and $1(=2^1)\times T$, as previously shown in FIG. 30. On the condition that an exposure amount unit obtained per a set time unit T is set to E in a case of the above assignment of the strobe time registers STBR1 to STBR8, 256(0~255×E) patterns of the cumulative exposure amount are realized in total.

Herein, FIG. 41 shows a relation between 4992 LED elements arranged in a main scanning direction, and the corresponding image data of 5 bits and driving pattern data of 8 bits. Furthermore, the driving pattern table memory 52*a* memorizes the driving pattern table indicative of the driving pattern corresponding to the tone value such as shown in FIG. 42.

Figure 43:
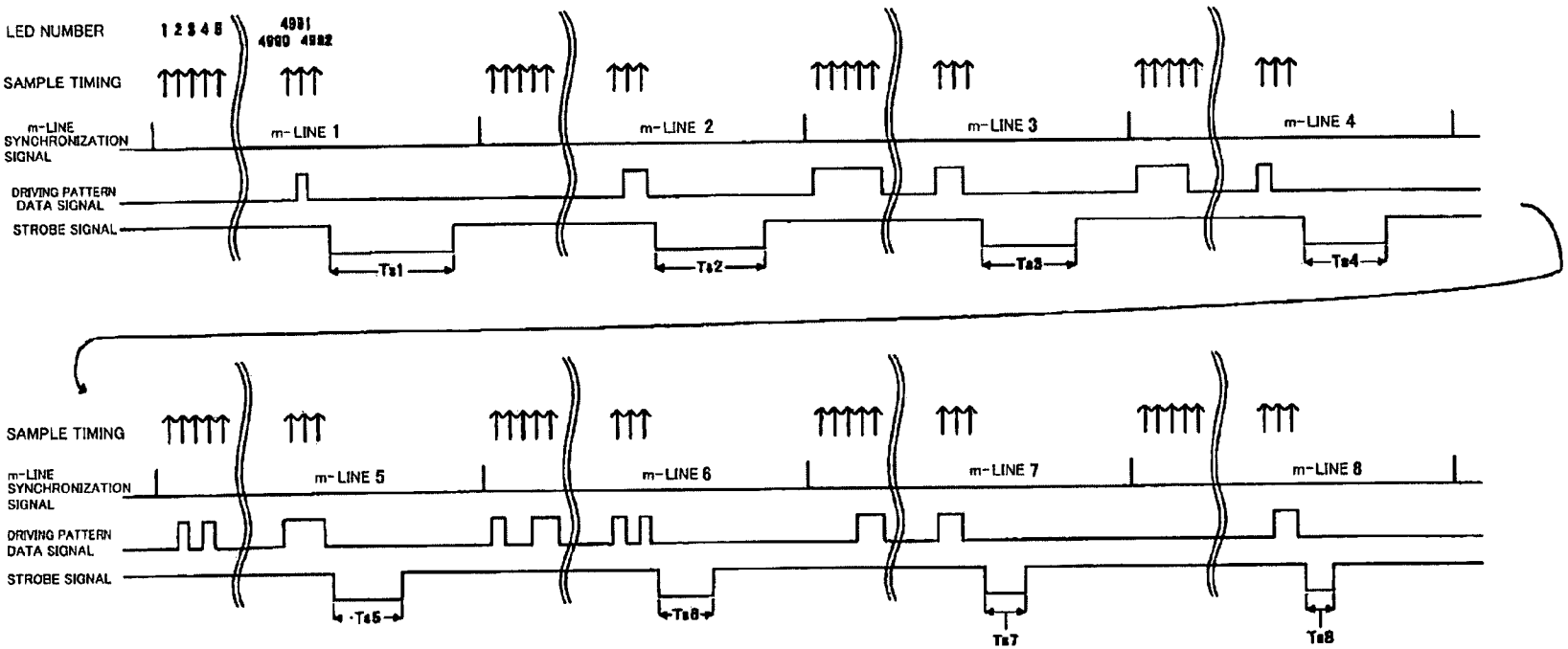
FIG. 43 is a chart illustrating timing of each signal output in a case where the driving pattern data shown in FIG. 41 are stored in a driving pattern data buffer according to the printing apparatus.
Figure 44:
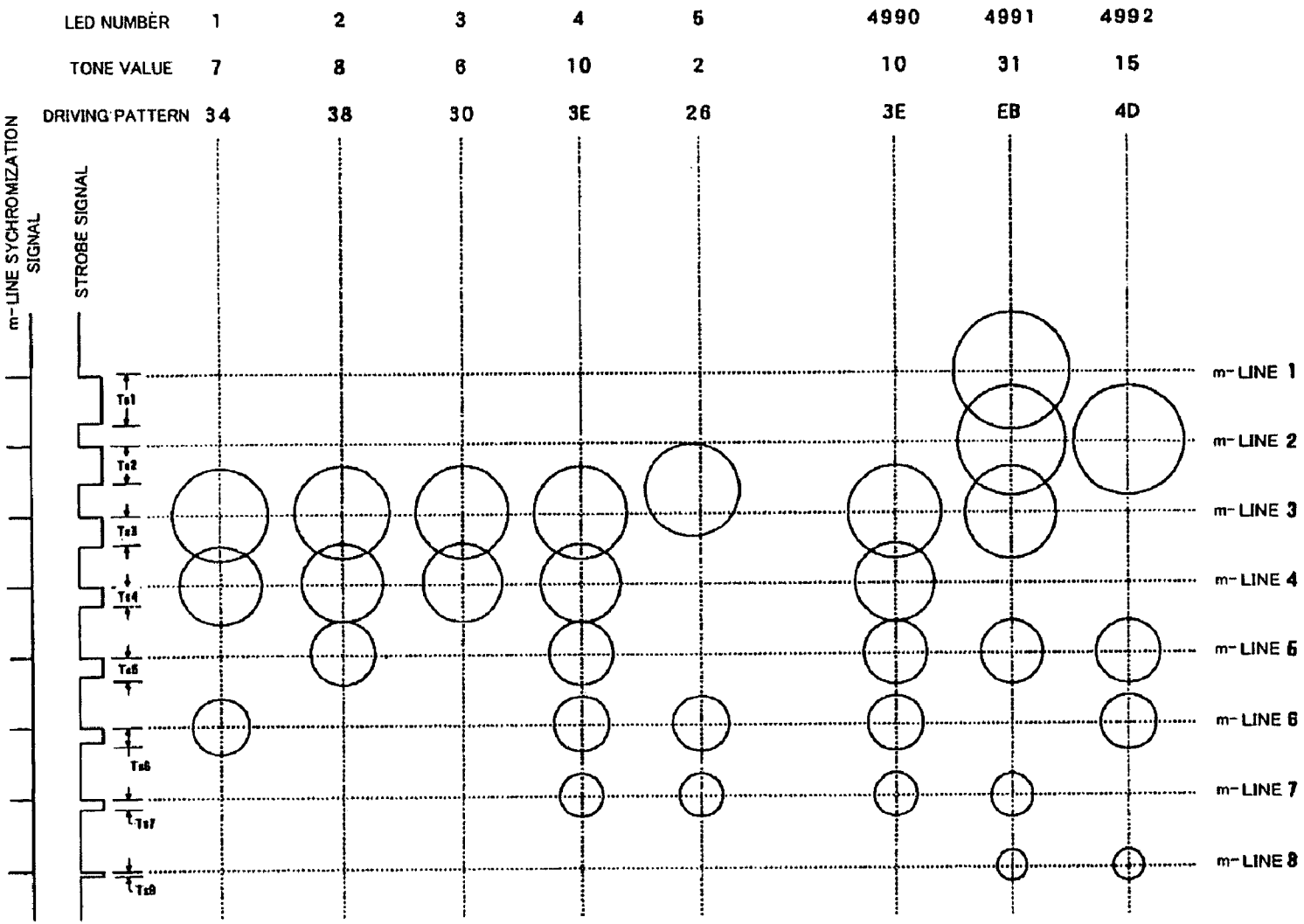
FIG. 44 shows a typical light emission status of the LED element as generating according to the image data and the driving pattern data shown in FIG. 41, in association with relations to waveforms of an m-line synchronization signal and a strobe signal.

The printing apparatus is in synchronization with the m-line synchronization signal in accordance with timing shown in FIG. 43 and reads out of the driving pattern converter 52 only the most significant bit PTN[7] of the driving pattern data PTN one by another as many as the number of the LED elements to generate and issue the driving pattern data signal to the LED head 3 where the driving pattern data buffer 52*b* stores the driving pattern data shown in FIG. 41. Subsequently, the printing apparatus outputs the strobe signal with a pulse width (Ts1=128×T) of the time set in the strobe time register STBR from the strobe time control circuit 53 to the LED head 3. Furthermore, the printing apparatus is in synchronization with the subsequent m-line synchronization signal and reads out only the most significant bit PTN[6] one by another as many as the number of the LED elements to generate and issue the driving pattern data signal to the LED head 3. The printing apparatus then outputs the strobe signal with a pulse width (Ts2=64×T) of the time set in the strobe time register STBR2 from the strobe time control circuit 53 to the LED head 3. The printing apparatus completes exposure of the data corresponding to the capacity for one line of the image data line buffer 51 upon repeating execution of the above described sequence eight times.

ttqFIG. 44 shows a typical-light emission status of the LED element as generating according to the image data and the driving pattern data shown in FIG. 41, in association with relation to waveforms of the m-line synchronization signal and the strobe signal. A typical spot diameter illustrated in FIG. 33 expresses only a mutual magnitude relation. In FIG. 33, furthermore, an interval between the m-line synchronization signals is set to one eighth of pitch 600 dpi in a main scanning direction of the LED element, i.e., pitch 4800 dpi. One pixel is configured with the driving pattern of m-lines 1 to 8.

The m-line 1 corresponds to the driving pattern data PTN[7] and the m-line 2 corresponds to the driving pattern data PTN[6]. In the same manner, the m-lines 3 to 8 correspond to the driving pattern data PTN[5] to PTN[8], respectively. The m-line 1 is exposed with a pulse width (Ts1=128×T) of the time set in the strobe time register STBR1, and the m-line 2 is exposed with a pulse width (Ts2=64×Y) of the time set in the strobe time register STBR2. In the same manner, the m-lines 3 to 8 are exposed with pulse widths (Ts3=32×T, Ts4=16×T, Ts5=8×T, Ts6=4×T, Ts7=2×T, and Ts8=1×T) set in the strobe time registers STBR3 to STBR8, respectively.

As shown in FIG. 42, the printing apparatus exposes the m-lines 3, 4, 6 respectively corresponding to the driving pattern data PTN[5], [4], and [2] upon converting the tone value "7" of the LED number 1 into the driving pattern data "34hex" using the driving pattern converter 52 according to a relation between the image data represented by the tone value of 5 bits transmitted from the host apparatus to the image data line buffer 51 and the driving pattern table indicative of the corresponding driving pattern. The printing apparatus executes the exposure by rendering the LED elements emit the light based on the driving pattern data PTN, as described above.

FIGS. 45(*a*) and 45(*b*) show a relation between the cumulative exposure amount of 256patterns obtained according to the assignment of the strobe times shown in FIG. 30 and the driving pattern table indicative of the corresponding driving patterns. The driving pattern table shown in FIG. 45(*a*) is such that the driving pattern used for the domain of the cumulative exposure amount 96×E to 101×E indicated by alphabet E in FIG. 37 is eliminated. Furthermore, the driving pattern used for the domain indicated by alphabet F in FIG. 37 is shifted to a portion of the cumulative exposure amount 122×E to 129×E in the driving pattern table shown in FIG. 45(*a*). The driving pattern table shown in FIG. 45(*b*) is such that the driving pattern used for the domain of the cumulative exposure amount 128×E to 135×E indicated by alphabet F in FIG. 37 is eliminated. As a result, the driving pattern table shown in FIG. 45(*b*) shows correspondence between the cumulative exposure amount and the driving pattern of 256 patterns obtained according to the assignment of the strobe times shown in FIG. 30 but the driving patterns used for the domains indicated by alphabets E, F in FIG. 37 are not used in the driving pattern table shown in FIG. 45(*b*).

Figure 46:
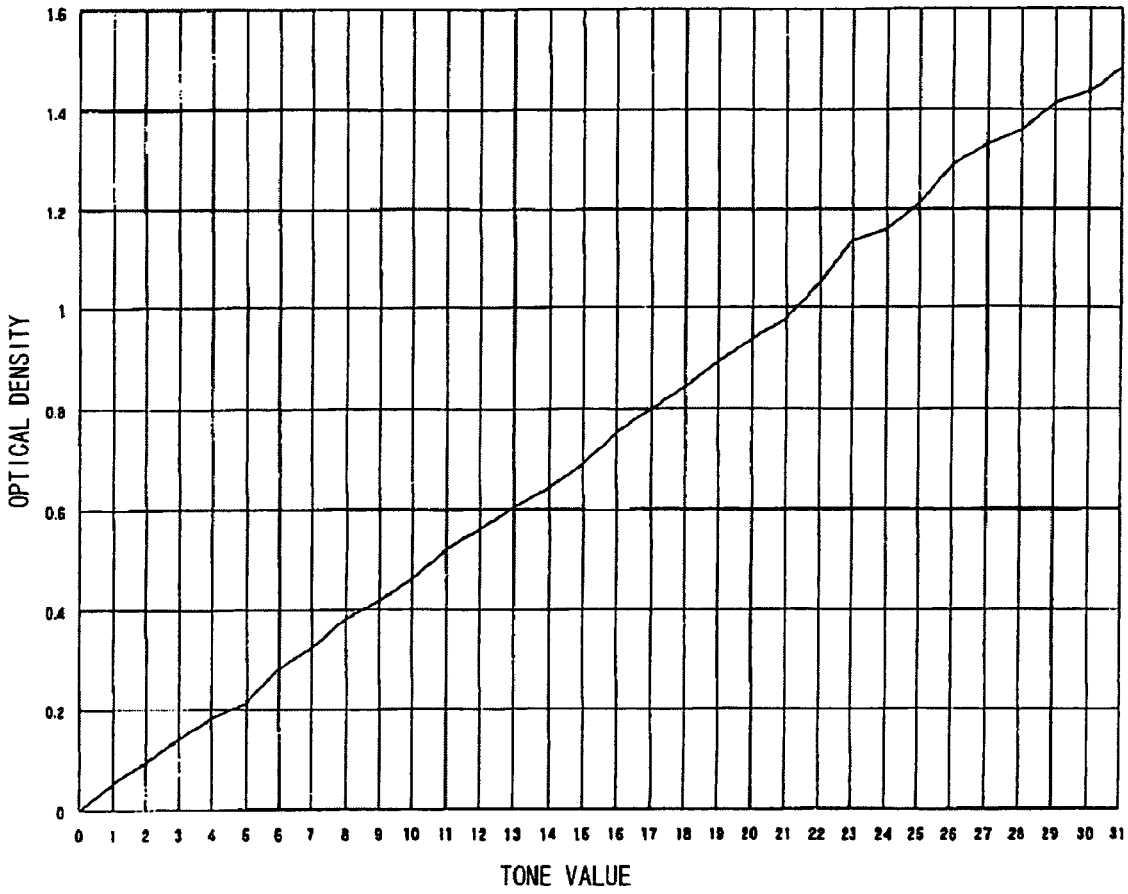
FIG. 46 is a graph illustrating a relation example between a tone value and an optical density in a case where a tone value is converted into a driving pattern based on the driving pattern table shown in FIG. 42.
Figure 47:
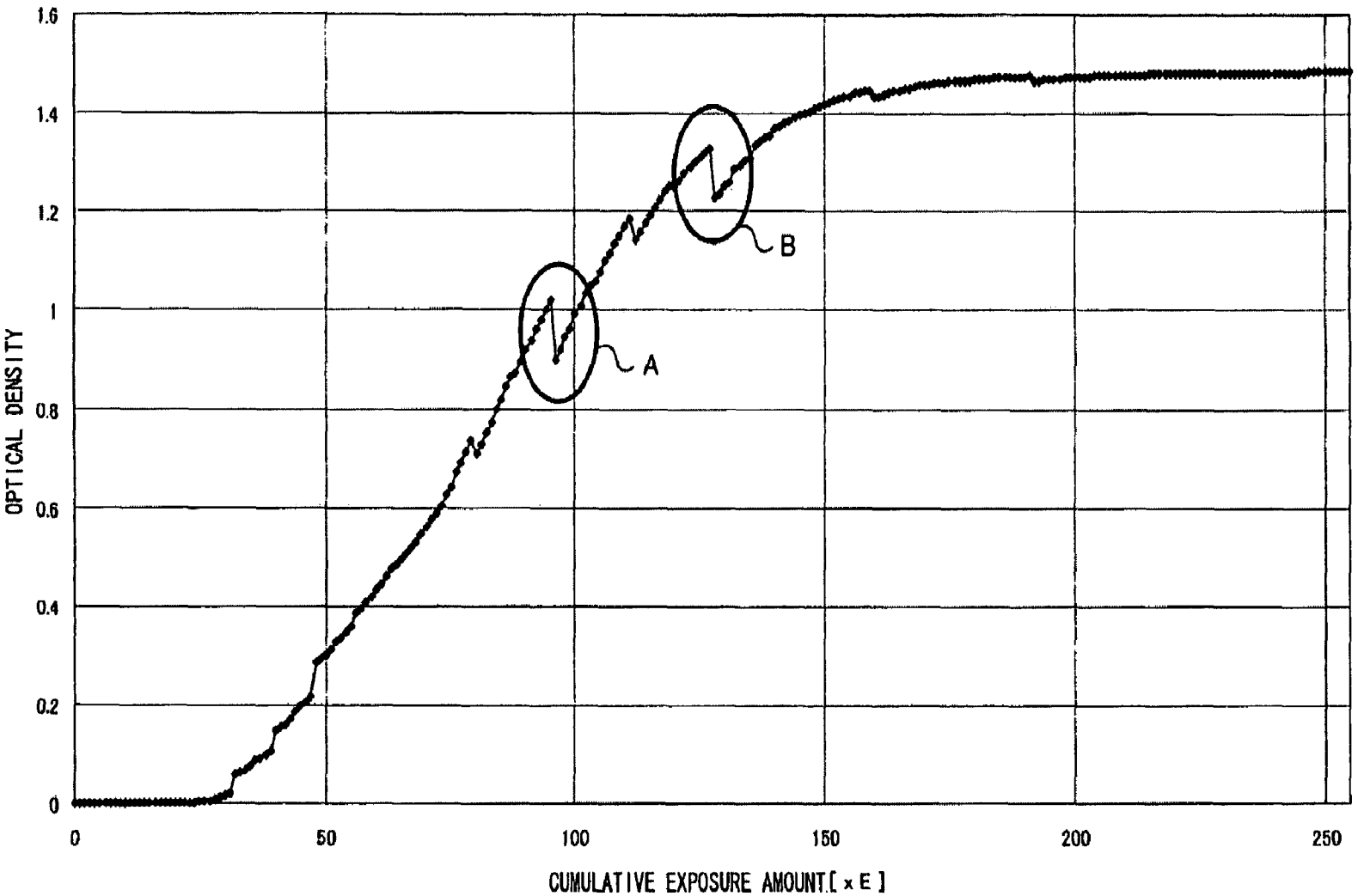
FIG. 47 is a graph showing a relation example between a cumulative exposure amount and an optical density at a time of implement of a tone expression using a conventional printing apparatus.

That is, the printing apparatus eliminates the driving pattern for the domain at which the optical density decreases as opposed to increase of the cumulative exposure amount in the cumulative exposure amount and the driving pattern data. The driving pattern data table as previously shown in FIG. 42 is generated base on FIGS. 35 and 45(*b*). In the printing apparatus, the driving pattern table memory 52*a* previously memorizes the driving pattern table such as above and the driving pattern converter 52 converts the tone value into the driving pattern based on the driving pattern table. The printing apparatus thus can eliminate such the domain that the optical density decreases as opposed to increase of the tone value, as shown in FIG. 46.

As described above, the printing apparatus according to the fifth embodiment of this invention eliminates the driving pattern for the domain at which the optical density decreases as opposed to increase of the cumulative exposure amount in the cumulative exposure amount and the driving pattern data to increase certainly the optical density in association with increase of the tone value, thereby being able to improve remarkably the printing quality.

It is to be noted that this invention is not limited to the above described embodiments. The above embodiments are explained referring to the printing apparatus having the array composed of the plurality of LED elements which is exemplified as the exposure element emitting the light on the photosensitive drum 1 for the exposure, but the present invention can adopt a laser, an EL (Electronic Luminescent) element array, or the like as the exposure element in a case of application of the electrophotographic printing apparatus. That is, this invention is about the printing apparatus having a recording head using an arbitrary recording element such as an exposure element, a heating element, or the like, and is applicable to such a printing apparatus that expresses the tone of multiple values per pixel as an assemblage of the image elements arranged at the approximately same position in a main scanning direction out of the image elements composing the predetermined number of main scanning line images deviated in an auxiliary scanning direction on the condition that the images are recorded upon shifting the recording head and a recording paper relatively to each other in an auxiliary scanning direction approximately perpendicular to a main scanning direction and the image recorded by the recording head in a main scanning direction is set to the main scanning line image.

Furthermore, this invention is applicable to such a printing apparatus as having an exposing unit for operating scan in a main scanning direction with a light beam emitted from the light emitting element to select the driving pattern of the image element composing one pixel in a case of the tone expression upon formation of one pixel with the exposure of plural times in an auxiliary scanning direction perpendicular to a main scanning direction.

This invention is also applicable to such a thermal printer as forming the image using a thermal head having an array composed of a plurality of light emitting elements to select an energizing pattern of the image element composing one pixel in a case of the tone expression upon formation of one pixel with energizing operation of plural times in an auxiliary scanning direction.

Furthermore, this invention is applicable to any types of apparatus for printing the predetermined recording medium and applicable suitably to, e.g., a printer, a facsimile machine, a photocopier, or a multi-function apparatus having combined functions of the printer, the facsimile machine, and the photocopier.

As described above, the present invention can be arbitrarily modified without departing from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A printing apparatus for printing an image onto a recording medium based on input image data, comprising:

an electrostatic latent image carrier for forming an electrostatic latent image; and an exposure controller for forming said electrostatic latent image corresponding to one pixel upon exposure of said electrostatic latent image carrier with a combination of a plurality of different exposure amounts, wherein said exposure controller performs said exposure with said combination of said plurality of exposure amounts in a manner to satisfy a condition for an index value LNR expressed by a following general equation (1) using an optical density od (n) standardized on the condition of the maximum optical density equal to 1.0, identification information comb assigned to identify each combination of said plurality of exposure amounts, and the number of varieties m of a cumulative exposure amount used for modulation of said image data $$LNR \leq 2/m \tag{1}$$

$$LNR(comb) = \sqrt{\sum_{n=0}^{m-3} [\{(od(n+2) - od(n+1)) - (od(n+1) - od(n))\}^2] / (m-2)}.$$

2. The printing apparatus according to claim 1, wherein said image data per pixel are set to multiple values, and wherein said exposure controller forms said electrostatic latent image expressing a tone per pixel upon said exposure of said electrostatic latent image carrier with said combination of said plurality of exposure amounts.

3. The printing apparatus according to claim 1, wherein said exposure controller forms said electrostatic latent image corresponding to one pixel upon assignment of a light emitting time of a light emitting unit used for said exposure with said combination of said plurality of exposure amounts.

4. The printing apparatus according to claim 1, wherein said exposure controller forms said electrostatic latent image corresponding to one pixel upon assignment of a luminous intensity of said light emitting unit used for said exposure with said combination of said plurality of exposure amounts.

5. The printing apparatus according to claim 1, wherein said exposure controller forms said electrostatic latent image expressing said tone per pixel upon exposing said electrostatic latent image carrier with said combination of said plurality of exposure amounts in proportion to two's power, respectively.

6. A printing apparatus for printing an image onto a recording medium based on input image data, comprising:

an electrostatic latent image carrier for forming an electrostatic latent image; and an exposure controller for exposing said electrostatic latent image carrier upon separating exposure positions of a light emitting unit used for exposure by a predetermined distance from a first to $n^{th}$ exposed locations, as overlapping said adjacent exposed locations at least partially, at a time of forming one pixel upon said exposure of plural times from the first to $n^{th}$ exposed locations, as well as for forming said electrostatic latent image expressing a tone per pixel upon control with different exposure amounts from the first to $n^{th}$ exposed locations, wherein said exposure controller arranges the first to $n^{th}$ exposed locations expressing said-tone per pixel at a location having the smallest summation of an optical density difference obtained from adjacent exposure patterns with respect to each of a first to $2^n$ exposure patterns at a time of said exposure with the first to $2^n$ exposure patterns providing different optical densities.

7. The printing apparatus according to claim 6, wherein said exposure controller exposes said electrostatic latent image carrier upon shifting by a predetermined distance an exposure position of said light emitting unit linearly in association with shift of said recording medium, from the first to $n^{th}$ exposed locations.

8. A printing apparatus for printing an image onto a recording medium based on input image data, comprising:

a light emitting unit arranged with a plurality of light emitting elements in an array form;

an electrostatic latent image carrier for forming an electrostatic latent image; and an exposure controller for exposing said electrostatic latent image carrier upon separating exposure positions of said light emitting unit by a predetermined distance from a first to $n^{th}$ exposed locations, as overlapping said adjacent exposed locations at least partially, at a time of forming one pixel upon said exposure of plural times from the first to $n^{th}$ exposed locations using said light emitting element, as well as for forming said electrostatic latent image expressing a tone per pixel upon control with different exposure amounts from the first to $n^{th}$ exposed locations, wherein said exposure controller arranges the first to $n^{th}$ exposed location expressing a tone per pixel at a location having the smallest summation of n optical density difference obtained from adjacent exposure patterns with respect to each of a first to $2^n$ exposure patterns at a time of said exposure with the first to $2^n$ exposure patterns providing different optical densities.

* * * * *